United States Patent [19]

Takada et al.

[11] Patent Number: 4,623,616

[45] Date of Patent: Nov. 18, 1986

[54] SILVER HALIDE PHOTOGRAPHIC LIGHT-SENSITIVE MATERIAL

[75] Inventors: Shun Takada; Takashi Kadowaki; Masao Sasaki; Toyoki Nishijima; Kaoru Onodera, all of Odawara, Japan

[73] Assignee: Konishiroku Photo Industry Co., Ltd., Tokyo, Japan

[21] Appl. No.: 716,352

[22] Filed: Mar. 26, 1985

[30] Foreign Application Priority Data

Mar. 30, 1984 [JP] Japan ..... 59-64379

[51] Int. Cl.[4] ..... G03C 1/40; G03C 1/30

[52] U.S. Cl. ..... 430/545; 430/552; 430/553; 430/626

[58] Field of Search ..... 430/505, 543, 552, 553, 430/626, 545

[56] References Cited

U.S. PATENT DOCUMENTS

| | | | |
|---|---|---|---|
| 3,575,705 | 4/1971 | Sato et al. | 430/626 |
| 3,645,743 | 2/1972 | Mucke et al. | 430/626 |
| 3,772,002 | 11/1973 | Ramello | 430/553 |
| 4,116,700 | 9/1978 | Himmelmann | 430/626 |
| 4,217,410 | 8/1980 | Nakamura et al. | 430/551 |
| 4,455,367 | 6/1984 | Seoka et al. | 430/505 |
| 4,537,857 | 8/1985 | Takada et al. | 430/553 |

*Primary Examiner*—Richard L. Schilling
*Attorney, Agent, or Firm*—Jordan B. Bierman

[57] ABSTRACT

A silver halide photographic light-sensitive material comprising a support bearing thereon a silver halide emulsion layer containing a diffusionproof coupler and being hardened with a hardening agent represented by Formula [II] and/or Formula [III] indicated below is enabled to acquire improved film properties and enjoy increased freedom from repression of latent image by using, as the diffusionproof coupler, a compound represented by Formula [I] indicated below: Formula [I]

Formula [I]

wherein $R_1$ denotes a straight or branched alkyl group having 2 to 4 carbon atoms; $R_2$ a ballast group; and X a hydrogen atom or a group capable of splitting off through reaction with the oxidation product of an aromatic primary amine type color developing agent.

Formula [II]

Formula [III]

wherein $R_3$ denotes a chlorine atom, a hydroxy group, an alkyl group, an alkoxy group, an amino group, an acylamino group, or a —OM group in which M denotes a monovalent metal atom; $R_4$ has the same meaning as $R_3$ except for the omission of the chlorine atom; $R_5$ and $R_6$ independently denote a chlorine atom, a hydroxy group, an alkyl group, an alkoxy group, or a —OM group in which M denotes a monovalent metal atom; Q and Q' independently denote a linking group —O—, —S—, or —NH—; L denotes an alkylene group or an arylene group; and p and q independently denote 0 or 1.

5 Claims, No Drawings

SILVER HALIDE PHOTOGRAPHIC LIGHT-SENSITIVE MATERIAL

BACKGROUND OF THE INVENTION

1. Field of the Invention

This invention relates to silver halide photographic light-sensitive materials, and more particularly to silver halide color photographic light-sensitive materials.

2. Description of the Prior Art

The silver halide photographic light-sensitive material (hereinafter referred to occasionally as "sensitive material" for short where there exists no possibility of entailing confusion) is produced by purposively superposing various photographic layers including a silver halide emulsion layer possessing photosensitivity and other various auxiliary layers vested with auxiliary functions such as, for example, an anti-irradiation layer, an anti-halation layer, an intermediate layer for intercepting interlayer effects, a filter layer, and a protective layer. The silver halide color photographic light-sensitive layer (hereinafter referred to occasionally as "color sensitive material" for short where there exists no possibility of entailing confusion) contains a coupler which produces a color spectral zone matched under a fixed mechanism with a sensitivity spectral zone of a silver halide emulsion layer.

In the photographic layers of these sensitive materials, a hydrophilic colloid such as of gelatin is used as a binder. Recently, the photographic layers are generally subjected to a hardening treatment so as to withstand the latest rapid treatment carried out at elevated temperatures and high pH values and the mechanical treatment performed as with an automatic developer and tended to entail infliction of damages such as scratches and stubs and, at the same time, to meet the requirement put forth in the aspect of productivity.

The success of this hardening treatment is indispensable to the assurance of quality in the phase of physical properties, except for special cases. So far, various hardening agents ranging from primitive hardening agents of inorganic compounds such as potash alum and chrom alum to organic hardening agents satisfying highly advanced photographic properties have been studied for feasibility.

Examples are chlorotriazine type hardening agents disclosed in U.S. Pat. Nos. 3,325,287 and 3,645,743 and Japanese Patent Application Laid-open SHO 57(1982)-40244, vinyl sulfone type hardening agents disclosed in U.S. Pat. No. 3,490,911 and West German Pat. (OLS) No. 2,749,260, and many other hardening agents such as of aldehyde type and epoxy type.

Besides the prerequisite for possessing a hardening effect, the requirements which the hardening agent is expected to fill are that the hardening agent should confer a glossly surface upon hardening, that it should allow the layers to adhere fast to the support, that it should enable the layers to harden quickly, that it should impart high scratch resistance to the layers, that it should do no harm to photographic properties, that it should avoid jeopardizing labor hygiene, and that it should have no possibility of entailing any environmental pollution.

Regarding these requirements, the S-triazine type hardening agents lack the rapid hardening property, the vinyl sulfone type hardening agents lack the gloss and the adhering property, and other hardening agents lack some other properties, whereas the chlorotriazine type hardening agents possess properties satisfying at least the aforementioned requirements.

These chlorotriazine type hardening agents, however, are deficient photographic properties, particularly because of regression of latent image. The regression of latent image suffered by these hardening agents is particularly prominent when these hardening agents are used in combination with 2-acylaminophenol type cyan couplers possessing highly advantageous properties.

Generally, the regression of latent image occurs abruptly in the early stage immediately after exposure and then describes a gentle declining slope. The shape of the curve of latent image regression and the magnitude of latent image regression are heavily affected by pH, pAg, humidity, and other chemical factors of the photographic layers, most directly of the emulsion layer, of the sensitive material.

In the color light-sensitive material, when the color developing layer of a specific type, particularly the color developing layer containing, as a coloring matter, a cyan coupler disposed to produce a readily fading cyan dye or a cyan coupler improved to retard fading, induces greater regression of latent image than other component layers, the color balance is seriously impaired even to the extent of depriving the color image of its value.

The hardening agent to be used as one of the essential components for the photographic layers in the aforementioned sensitive material lowers the pH value of the photographic layer as the hardening reaction proceeds. Thus, the hardening reaction may well be regarded as one factor for the regression of latent image.

For the prevention of the regression of latent image and in view of the peculiar behavior of pH mentioned above, attempts are made at increasing the pH value of the photographic layer. Generally, an increase in the pH value entails aggravated fogging and degraded long-term storability. Thus, the increase of the pH value does not prove an advantageous measure for the prevention of latent image regression from the standpoint of all the properties of the sensitive material.

Measures for the prevention of latent image regression by incorporation of various stabilizers as disclosed in Japanese Patent Application Laid-open SHO 56(1981)-1043 and British Pat. Nos. 1,458,197, 1,389,089, 1,386,630, and 1,378,354 are effective as claimed. However, the addition of such stabilizers results in lowered sensitivity, degraded long-term storability, and spoiled processing liquid. Japanese Patent Application Laid-open SHO 48(1973)-3527 teaches a method of preventing the regression of latent image by having a specific sensitizing dye adsorbed on silver halide particles. This method spoils the harmony between the sensitivity spectrum required by the emulsion layer and the absorption spectrum given by the dye, and brings about contamination of the dye also impairs storability. This method is far from serving as a satisfactory measure for the prevention of latent image regression for the sake of the sensitive material, particularly the color sensitive material.

SUMMARY OF THE INVENTION

An object of this invention is to provide a color sensitive material which enjoys satisfactory film properties and experiences substantially no regression of latent image.

The object of this invention described above is attained by a silver halide photographic light-sensitive material comprising a support bearing thereon a silver halide emulsion layer containing a diffusionproof coupler and being hardened with a hardening agent represented by the general formula [II] and/or the general formula [III] indicated below, which silver halide photographic light-sensitive material is characterized in that the diffusionproof coupler is a coupler represented by the general formula [I] indicated below.

General formula [I]

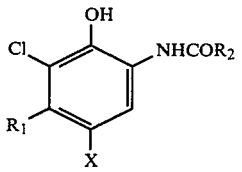

wherein $R_1$ denotes a straight or branched alkyl group having 2 to 4 carbon atoms, $R_2$ a ballast group, and X a hydrogen atom or a group capable of splitting off through reaction with the oxidation products of an aromatic primary amine type color developing agent, General formula [II]

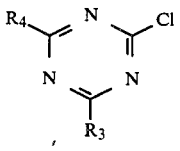

General formula [III]

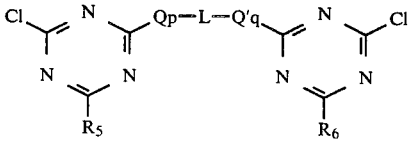

wherein $R_3$ denotes a chlorine atom, a hydroxy group, an alkyl group, an alkoxy group, an amino group, an acylamino group, or a —OM group in which denotes a monovalent metal atom; $R_4$ has the same meaning as $R_3$ except for the omission of the chlorine atom, $R_5$ and $R_6$ independently denote a chlorine atom, a hydroxy group, an alkyl group, an alkoxy group, or a —OM group in which denotes a monovalent metal atom; Q and Q' independently denote a linking group —O—, —S—, or —NH—, L denotes an alkylene group or an arylene group, and p and q independently denote 0 or 1.

The other objects and characteristic features of the present invention will become apparent to those skill in the art as the disclosure is made in the following description of preferred embodiments of the invention.

DETAILED DESCRIPTION OF THE INVENTION

In this invention, typical examples of the alkyl group denoted by the symbol $R_1$ in the aforementioned general formula [I] are ethyl group, propyl group, butyl group, iso-propyl group, iso-butyl group, sec-butyl group, and tert-butyl group. These groups may possess a substituent. Examples of this substituent include acylamino groups such as, for example, acetyl amino group and alkoxy groups such as, for example, methoxy group.

$R_1$ in itself, however, is desired to be in an unsubstituted form.

The ballast group denoted by $R_2$ is an organic group possessing size and shape capable of conferring upon coupler molecule ample bulkiness enough to preclude diffusion of such coupler molecules from the layer containing the coupler molecules to other layer containing substantially no coupler molecules.

Typical examples of the ballast group are alkyl groups and aryl groups having a total of 8 to 32 carbon atoms.

These alkyl groups and aryl groups may possess a substituent. Examples of the substituent which the aryl group may possess include alkyl group, aryl group, alkoxy group, aryloxy group, carboxy group, acyl group, ester group, hydroxy group, cyano group, nitro group, carbamoyl group, carbonamide group, alkylthio group, arylthio group, sulfonyl group, sulfonamide group, sulfamoyl group, and halogens. Examples of the substituent which the alkyl group may possess include the substituents for the aryl group cited above, except for alkyl group.

In all the examples of the ballast group, those represented by the following general formula prove particularly desirable.

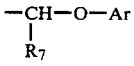

In the general formula, $R_7$ denotes an alkyl group having 1 to 12 carbon atoms and Ar denotes an aryl group such as phenyl group. The aryl group may possess a substituent. Examples of this substituent include alkyl group, hydroxy group, and alkylsulfonamide group. The most desirable examples of the substituent are branched alkyl groups such as t-butyl group.

The group denoted by the symbol X in the general formula [I] which is eliminable through reaction with the oxidant of an aromatic primary amine type main color-developing agent is well known to any person of ordinary skill in the art. It advantageously performs its part by modifying the reactivity of the coupler or, on departure from the coupler and arrival in the coupler-containing applied layer or other layer in the silver halide color photographic sensitive material, fulfilling the functions such as control of development, control of bleaching, and color compensation. Typical examples of the group include halogen atoms represented by chlorine and fluorine, and substituted and unsubstituted alkoxy group, aryloxy group, arylthio group, carbamoyloxy group, acyloxy group, sulfonyloxy group, and sulfonamide group, and heteroylthio group and heteroyloxy group. Particularly desirable examples of X are hydrogen atom and chlorine atom.

More specific descriptions of this particular group are found in the specifications of Japanese Patent Application Laid-open SHO 50(1975)-10135, SHO 50(1975)-120334, SHO 50(1975)-130441, SHO 54(1979)-48237, SHO 51(1976)-146828, SHO 54(1979)-14736, SHO 47(1972)-37425, SHO 50(1975)-123341. and SHO 58(1973)-95346, Japanese Patent Publication SHO 48(1973)-36894, and U.S. Pat. Nos. 3,476,563, 3,737,316, and 3,227,551.

Now, concrete examples of the phenol type cyan coupler represented by the general formula [I] will be cited below in the form of combinations of $R_1$, $R_2$, and X of the general formula [I].

General formula [I]
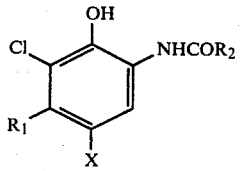
| Coupler No. | $R_1$ | X | $R_2$ |
|---|---|---|---|
| (I-1) | $-C_2H_5$ | $-Cl$ | 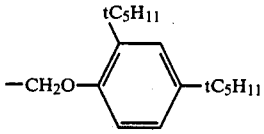 |
| (I-2) | $-C_2H_5$ | 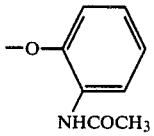 | 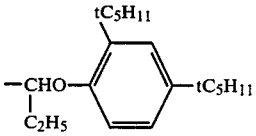 |
| (I-3) | 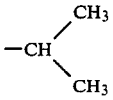 | $-Cl$ | 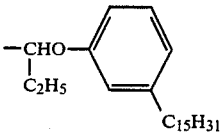 |
| (I-4) | $-C_2H_5$ | $-Cl$ | 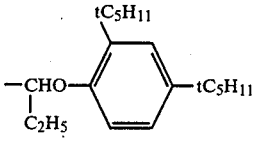 |
| (I-5) | $-C_2H_5$ | $-Cl$ | 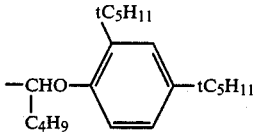 |
| (I-6) | $-C_4H_9$ | $-F$ | 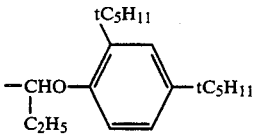 |
| (I-7) | $-C_2H_5$ | $-F$ | 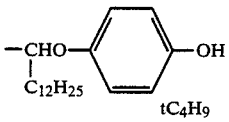 |
| (I-8) | $-C_2H_5$ | $-Cl$ | 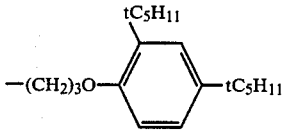 |
| (I-9) | $-C_2H_5$ | $-F$ | 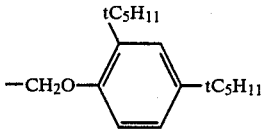 |

-continued
General formula [I]
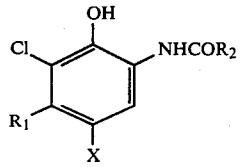
| Coupler No. | $R_1$ | X | $R_2$ |
|---|---|---|---|
| (I-10) | $-C_4H_9$ | $-Cl$ | 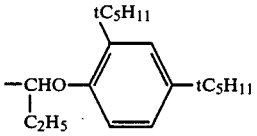 |
| (I-11) | $-C_2H_5$ | $-Cl$ | 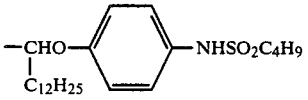 |
| (I-12) | $-C_2H_5$ | $-Cl$ | 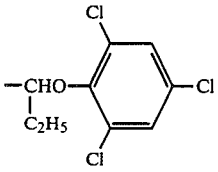 |
| (I-13) | $-CH(CH_3)_2$ | $-Cl$ | $-C_{18}H_{37}$ |
| (I-14) | $-C_2H_5$ | $-F$ | 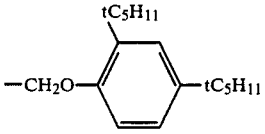 |
| (I-15) | $-C_2H_5$ | 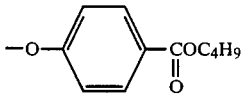 | 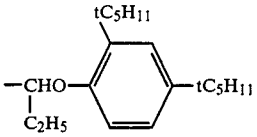 |
| (I-16) | $-C_2H_5$ | $-Cl$ | 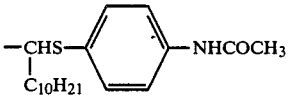 |
| (I-17) | $-C_3H_7$ | $-Cl$ | 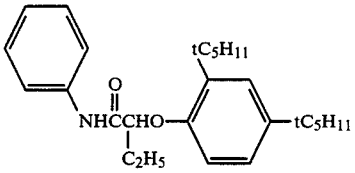 |
| (I-18) | $-C_3H_7$ | $-Cl$ | 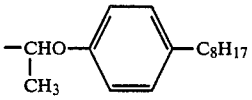 |
| (I-19) | $-C_2H_4NHCCH_3$ ‖ O | $-Cl$ | 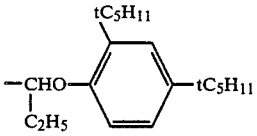 |

-continued

General formula [I]

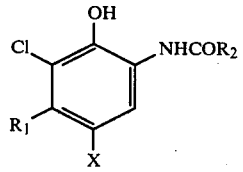

| Coupler No. | $R_1$ | X | $R_2$ |
|---|---|---|---|
| (I-20) | $-C_3H_6OCH_3$ | —Cl | 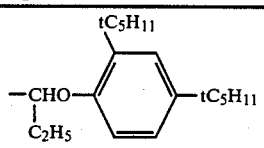 |
| (I-21) | $-C_2H_5$ | —Cl | 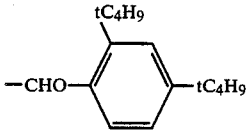 |

Now, the process for the synthesis of the typical compounds of this invention will be described below. The other compounds according with this invention can be synthesized by the same process.

Synthesis of typical compound (1)

(1)-a. Synthesis of 2-nitro-4,6-dichloro-5-ethylphenol

In 150 ml of glacial acetic acid, 33 g of 2-nitro-5-ethylphenol, 0.6 g of iodine, and 1.5 g of ferric chloride were dissolved. Into the resultant solution, 75 ml of sulfuryl chloride was dropped at 40° C. over a period of three hours. The precipitate which was formed during the course of the dropwise addition of sulfuryl chloride was dissolved after completion of this dropwise addition by thermally refluxing the reaction mixture. This thermal reflux required about two hours' time. The resultant reaction solution was poured into cold water. The crystals consequently formed in the cold water were refined by being recrystallized from methanol. The compound of (1)-a was identified by nuclear magnetic resonance spectroscopy and elementary analysis.

(1)-b. Synthesis of 2-amino-4,6-dichloro-5-ethylphenol

In 300 ml of alcohol, 21.2 g of the compound of (1)-a was dissolved. The resultant solution and a catalytic amount of Raney nickel added thereto were treated with continuous flow of hydrogen under normal pressure until absorption of hydrogen ceased. After completion of the reaction, the reaction mixture was filtered to remove the Raney nickel and then distilled under a vacuum to expel the alcohol. The compound of (1)-b occurring as the residue of the distillation was subjected in its unrefined form to the subsequent step of acylation.

(1)-c. Synthesis of 2-[(2,4-di-tert-amylphenoxy)acetamide]-4,6-dichloro-5-ethylphenol In a mixed solution consisting of 500 ml of glacial acetic acid and 16.7 g of sodium acetate, 18.5 g of the crude amino compound obtained in (1)-b was dissolved. Into the resultant solution, a solution of 28.0 g of 2,4-di-tert-aminophenoxy-acetic acid chloride in 50 ml of acetic acid was added dropwise at room temperature over a period of 30 minutes. After the addition, the resultant reaction solution was stirred for 30 minutes and then poured into ice water. The precipitate formed consequently in the ice water was collected by filtration dried, and crystallized twice from acetonitrile to obtain the product aimed at. The product was identified by elementary analysis and nuclear magnetic resonance spectroscopy.

| | $C_{26}H_{35}N_1O_3Cl_2$ | | | |
|---|---|---|---|---|
| | C | H | N | Cl (%) |
| Calculated | 65.00 | 7.34 | 2.92 | 14.76 |
| Found | 64.91 | 7.36 | 2.99 | 14.50 |

In the aforementioned general formula [II], the alkyl groups denoted by the symbols $R_3$ and $R_4$ are straight or branched alkyl groups such as, for example, methyl group, ethyl group, and butyl group. The alkoxy groups denoted by the same symbols are methoxy group and ethoxy group, for example. These groups may possess a substituent. The amino groups denoted by the same symbols may possess a substituent. Examples of the substituent are alkyl group, aryl group, $-NH_2$, $-NHCH_3$, $-NHC_2H_5$, and

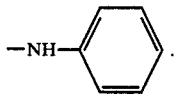

The acylamino groups denoted by the same symbols may similarly possess a substituent. Examples of the substituent are alkyl group and aryl group, $-NHCOCH_3$, and

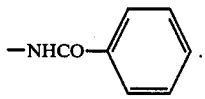

In the case of the —OM groups denoted by the symbols $R_3$ and $R_4$, examples of the component M are sodium atom and potassium atom.

Concerning the hardening agent represented by the aforementioned general formula [II], various descriptions are found in U.S. Pat. No. 3,645,743, Japanese Patent Publication SHO 47(1972)-6151, SHO 47(1972)-33380, and SHO 51(1976)-9607, and Japanese Patent Application SHO 48(1973)-19220, SHO 51(1976)-78788, SHO 52(1977)-60612, SHO 52(1977)-128130, SHO 52(1977)-130326, and SHO 56(1981)-1043. The various hardening agents disclosed therein can be used in this invention in due consideration of the aforementioned standard requirements.

Then, the alkyl groups denoted by the symbols $R_5$ and $R_6$ in the aforementioned general formula [III] are straight and branched groups. Examples of the alkyl groups are methyl group, ethyl group, and butyl group. In the case of the alkoxy groups denoted by the same symbols, examples are methoxy group, ethoxy group, and butoxy group. All these groups may possess a substituent. In the case of the —OM groups further denoted by the same symbols, examples of the component M are sodium atom or potassium atom.

The alkyl group denoted by the symbol L is a straight or branched alkyl group. Examples of the alkyl group are $—CH_2—$, $—(CH_2)_2—$, $—(CH_2)_3—$ groups. Examples of the arylene group denoted by the symbol L are p-, o-, and m-phenylene groups.

Concerning the hardening agent represented by the general formula [III], descriptions are found in Canadian Pat. No. 895,808, Japanese Patent Publication SHO 58(1983)-33542, and Japanese Patent Application SHO 57(1982-40244. The hardening agents disclosed therein can be used in this invention in due consideration of the aforementioned standard requirements.

The compounds represented by the aforementioned general formulas [II] and [III] can be suitably incorporated in at least one or more of the photographic layers according with this invention. This incorporation is effected by dissolving the compounds in water or alcohol (such as, for example, methyl alcohol or ethyl alcohol) and adding 1 to 100 mg, preferably 5 to 50 mg, of the resultant solution per g of gelatin.

Now, typical concrete examples of the compounds represented by the general formulas [II] and [III] will be cited below. These examples are purely illustrative and not limitative of this invention.

Examples of the compound represented by the general formula [II]:

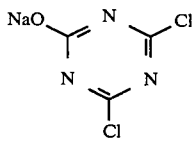
(II-1)

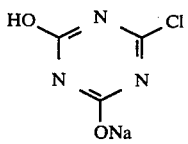
(II-2)

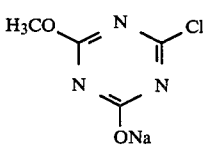
(II-3)

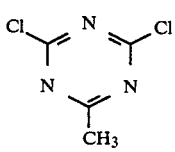
(II-4)

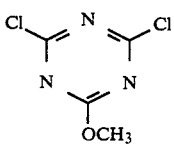
(II-5)

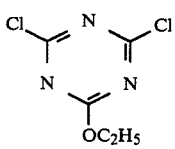
(II-6)

-continued

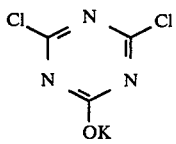
(II-7)

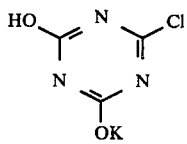
(II-8)

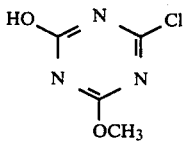
(II-9)

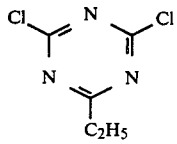
(II-10)

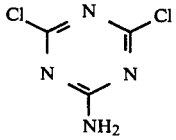
(II-11)

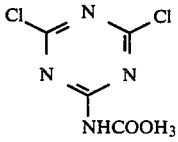
(II-12)

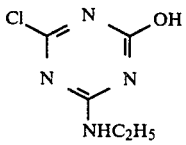
(II-13)

Examples of the compound represented by the general formula [III]:

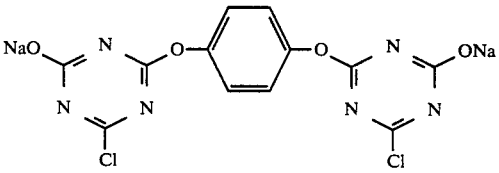
(III-1)

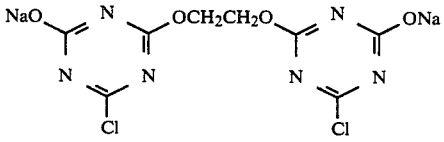
(III-2)

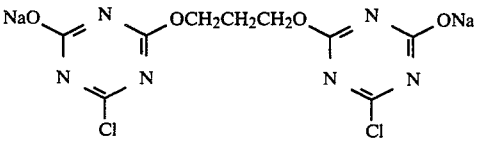
(III-3)

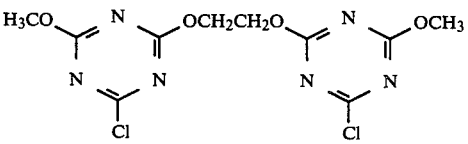
(III-4)

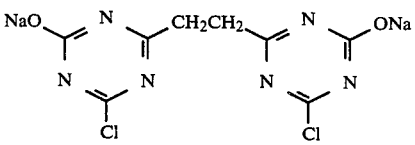
(III-5)

-continued

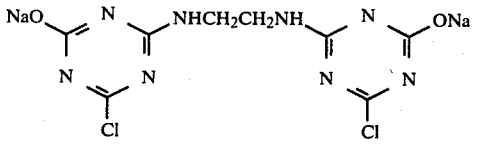
(III-6)

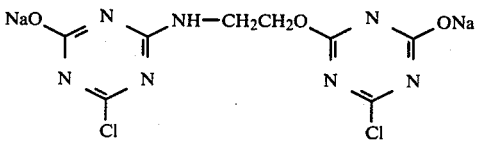
(III-7)

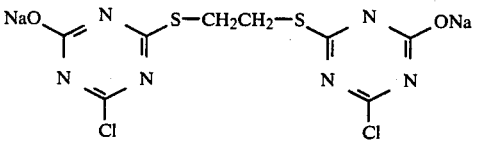
(III-8)

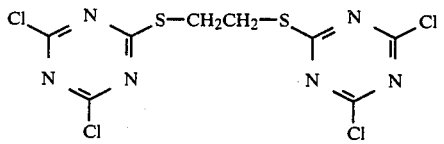
(III-9)

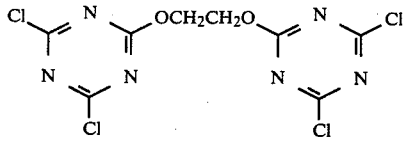
(III-10)

The silver halide photographic sensitive material of the present invention can be in any stratal configuration as it has at least one silver halide emulsion layer superposed on a substrate. There is no particular limit to the number of layers including the silver halide emulsion layer and non-sensitive layers and to the order of arrangement of such layers. Typical examples are positive and negative color films, color printing papers, color slides, and special sensitive materials for printing, X-ray, and high-resolution development. The color printing papers forms a particularly advantageous application. Generally, the aforementioned silver halide emulsion layer and most of the non-sensitive layers form hydrophilic colloidal layers containing a hydrophilic binder. Examples of the hydrophilic binder include gelatin and gelatin derivatives such as acylated gelatin, guandylated gelatin, carbamylated gelatin, cyanoethanolated gelatin, and esterified gelatin.

The cyan coupler according with this invention represented by the general formula [I] (hereinafter referred to as "cyan coupler according with this invention") can be formed by the method generally adopted in the formation of any ordinary cyan coloring matter. The photographic element is formed by depositing on a substrate the silver halide emulsion layer containing the cyan coupler according with this invention.

This photographic element may be monochromic or polychromic in type. When the element is polychromic, the cyan coupler according with the present invention is generally contained in the red-sensitive silver halide emulsion layer. Optionally, it may be contained in an unsensitized emulsion layer or an emulsion layer possessing sensitivity in the three primary color spectral regions excluding red. The component units which make up the color image in the present invention are mono-emulsion layers or poly-emulsion layers possessing sensitivity in fixed regions of spectrum.

Incorporation of the cyan coupler according with this invention in a given emulsion can be effected by any of the methods known to the art. For example, the silver halide emulsion for use in the present invention is prepared by dissolving cyan couplers according with this invention either independently or collectively in such high boiling organic solvents as phthalic esters (represented by dibutyl phthalate, dioctyl phthalate, etc.), phosphoric esters (represented by tricresyl phosphate, triocty phosphate, etc.), and N,N-dialkyl-substituted amides (represented by N,N-diethyl laurylamide) and such low boiling organic solvents such as butyl acetate and butyl propionate used either independently or collectively as a mixture, mixing the resultant solution with an aqueous gelatin solution containing a surfactant, then dispersing the resultant mixture into an emulsified form with a high-speed rotary mixer, a colloid mill, or an ultrasonic dispersing machine, and adding the resultant emulsion to silver halide.

When the cyan coupler according with this invention is added to the silver halide emulsion, the amount of the cyan coupler is generally in the range of about 0.05 to 2 mols, preferably 0.1 to 1 mol, per mol of silver halide.

When the silver halide color photographic sensitive material of this invention is a polychromic element, the layers required for photographic elements including the aforementioned image-forming unit can be arranged in various orders known to the art.

The typical polychromic photographic element is formed by depositing on a substrate a cyan color image-forming component unit made of at least one red-sensitive silver halide emulsion possessing a cyan color-forming coupler (including at least one cyan color-forming coupler according with this invention represented by the general formula [I]), a magenta color image-forming component unit made of at least one green-sensitive silver halide demulsion possessing at least one magenta color-forming coupler, and a yellow color image-forming component unit made of at least one blue-sensitive silver halide emulsion layer possessing at least one yellow color-forming coupler.

The photographic element may possess additional non-sensitive layers such as, for example, a filter layer, an intermediate layer, a protective layer, a halation-proof layer, an undercoat layer.

The yellow color-forming coupler for use in this invention is desired to be a compound represented by the general formula [IV] indicated below.

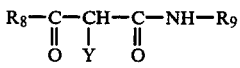
General formula [IV]

[wherein $R_8$ denotes an alkyl group (such as, for example, methyl group, ethyl group, propyl group, or butyl group) or an aryl group (such as, for example, phenyl group or p-methoxyphenyl group), $R_9$ denotes an aryl group, and Y denotes a hydrogen atom or a group eliminable during the course of a color-developing reaction].

The yellow coupler to form the color image in accordance with this invention is particularly desired to be a compound represented by the general formula [IV'] indicated below.

General formula [VI']

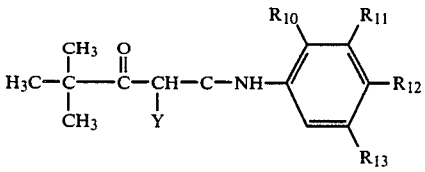

[wherein $R_{10}$ denotes a halogen atom, an alkoxy group, or aryloxy group, $R_{11}$, $R_{12}$, and $R_{13}$ independently denote a hydrogen atom, a halogen atom, an alkyl group, an alkenyl group, an alkoxy group, an aryl group, an aryloxy group, a carbonyl group, a sulfonyl group, a carboxyl group, an alkoxycarbonyl group, a carbamyl group, a sulfon group, a sulfamyl group, a sulfonamide group, an acylamide group, a ureido group, or an amino group, and Y has the same meaning as X in the aforementioned general formula [I].

Various yellow couplers usable for this invention are described in U.S. Pat. Nos. 2,778,658, 2,875,057, 2,908,573, 3,227,155, 3,227,550, and 3,253,924, for example.

Typical concrete examples of the compound represented by the general formula [IV] will be enumerated below.

Concrete examples of the compound of general formula [IV]:

(IV-1)

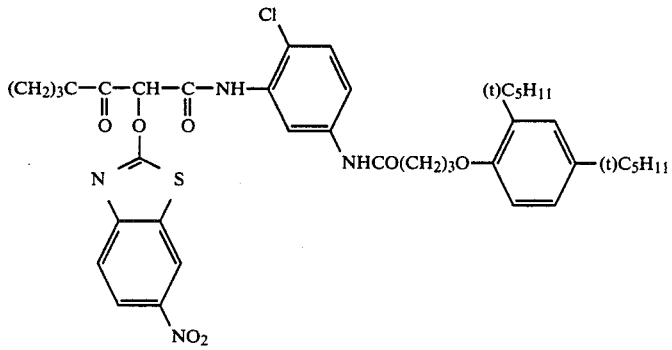

(IV-2)

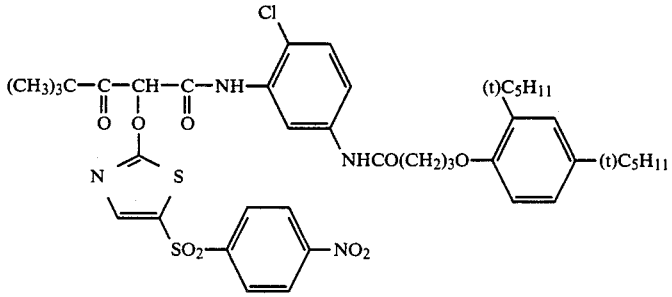

(IV-3)

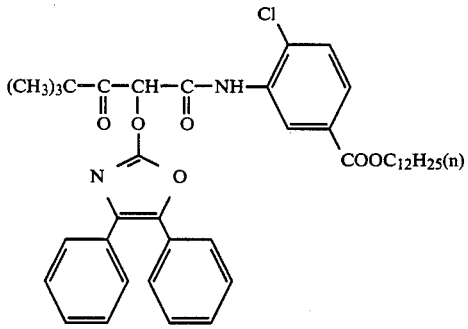

(IV-4)

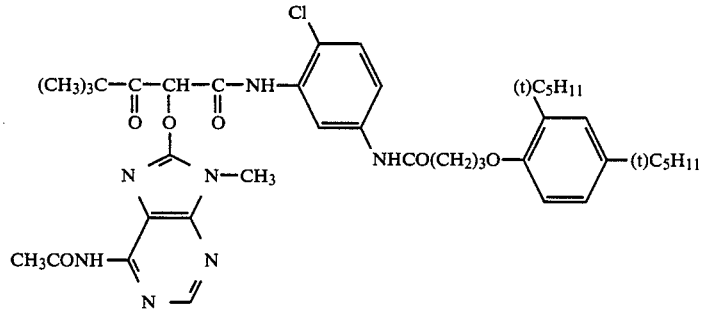

-continued
(IV-5)
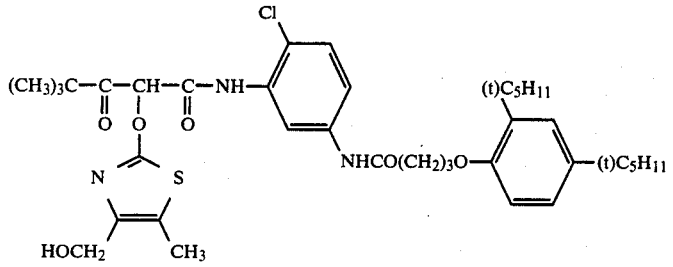
(IV-6)
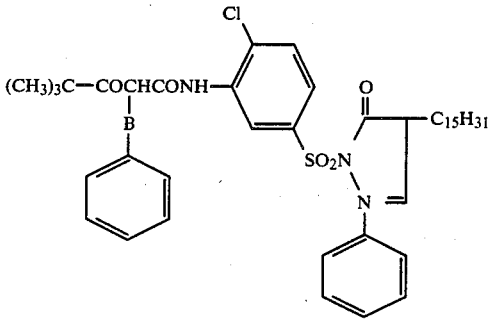
(IV-7)
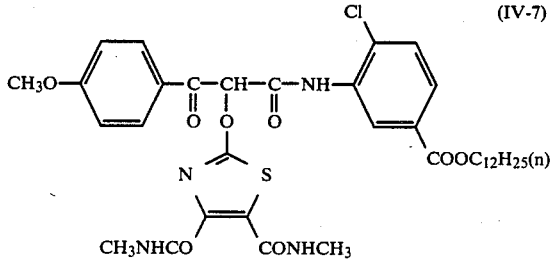
(IV-8)
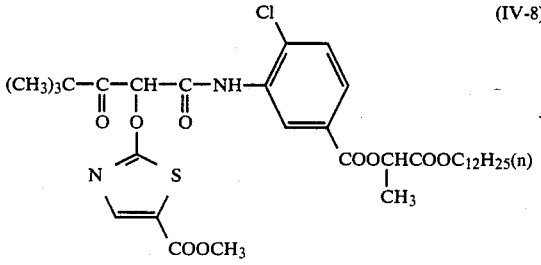
(IV-9)
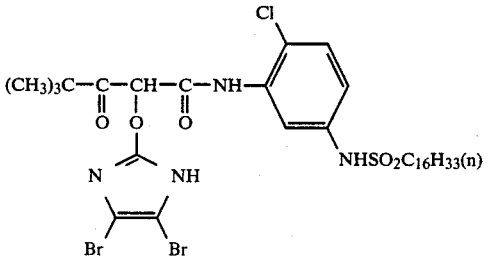
(IV-10)
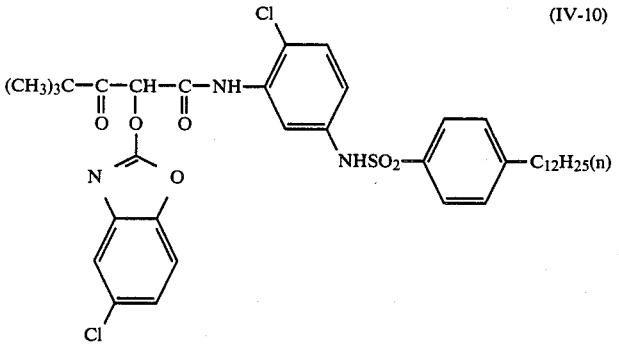
(IV-11)
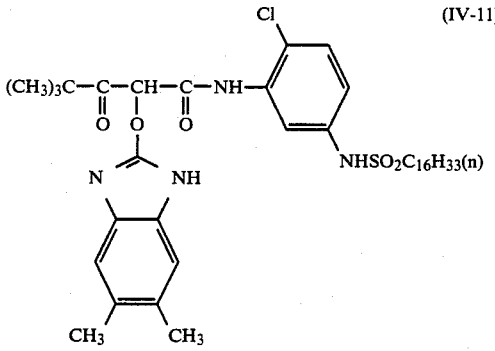
(IV-12)
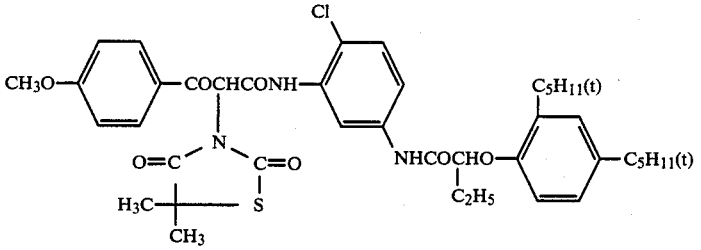

-continued (IV-13)

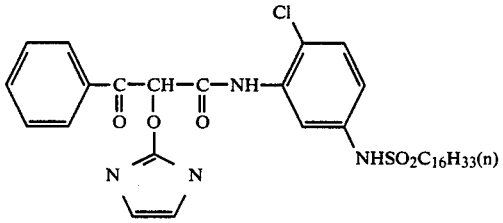

The yellow couplers enumerated above are synthesized by various methods disclosed in Japanese Patent Application Laid-open SHO 50(1975)-87650, SHO 51(1976)-131325, SHO 51(1976)-139333, SHO 52(1977)-43426, and SHO 52(1977)-150631, U.S. Pat. Nos. 3,408,174, and 3,237,554, for example.

Yellow couplers of another type represented by the general formula [V] indicated below are also usable.

General formula [V]

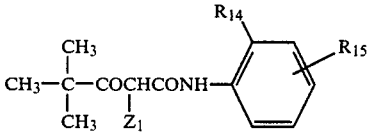

[wherein $R_{14}$ denotes a hydrogen atom, a halogen atom, or an alkoxy group, $R_{15}$ denotes a group denoted by $-NHCOR_{16}$, $-NHSO_2R_{16}$, $-COOR_{16}$, or

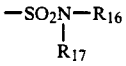

(where $R_{16}$ and $R_{17}$ independently denote an alkyl group which may be in a substituted form), and $Z_1$ denotes a group eliminable by coupling and linked to the active site of the aforementioned general formula [IV] through the medium of the nitrogen atom].

Now, typical concrete examples of the yellow coupler represented by the aforementioned general formula [V] will be cited below.

Concrete examples of the compound of the general formula [V]:

(Y-1)

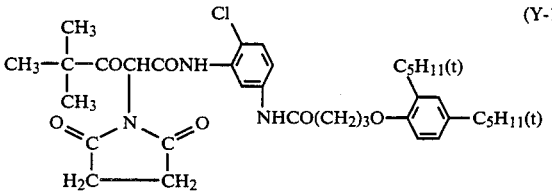

(Y-2)

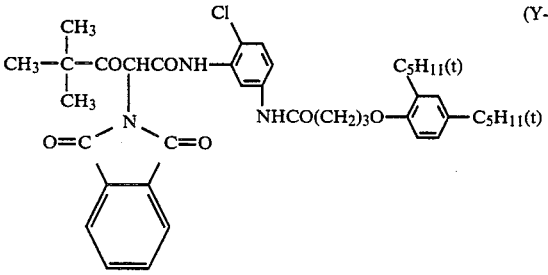

-continued (Y-3)

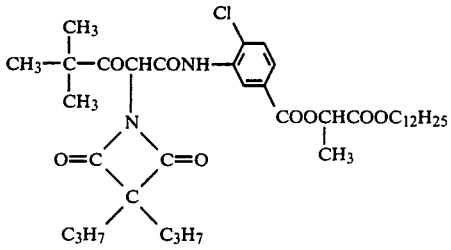

(Y-4)

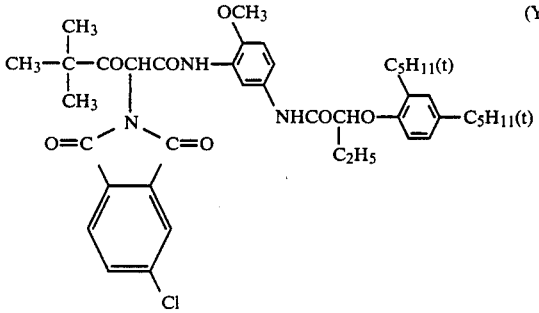

(Y-5)

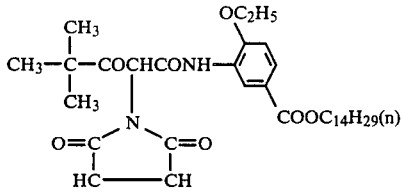

(Y-6)

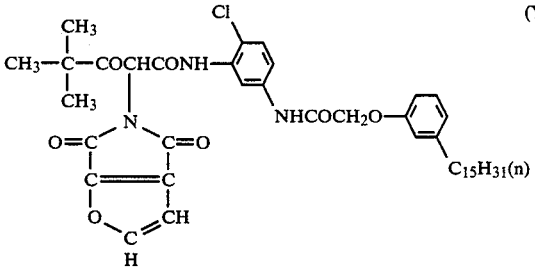

(Y-7)

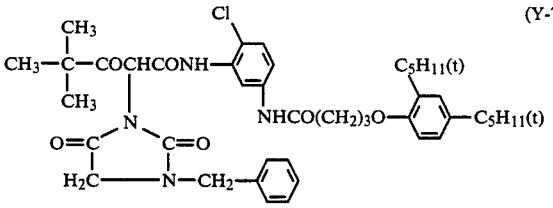

-continued
(Y-8)
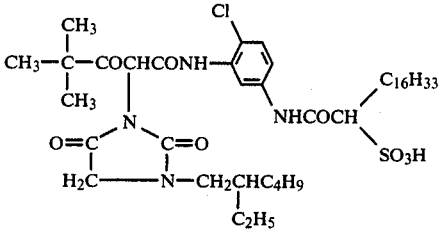
(Y-9)
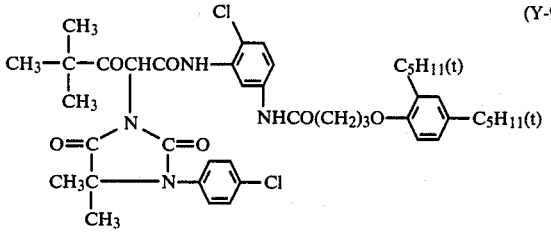
(Y-10)
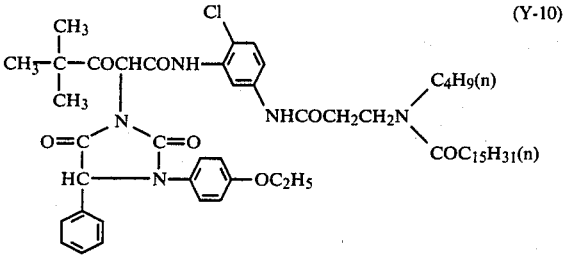
(Y-11)
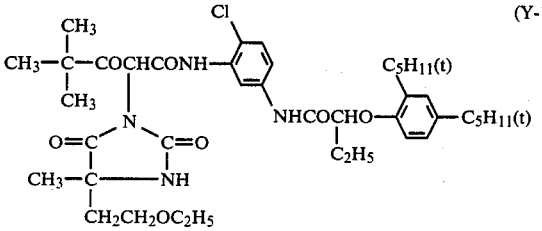
(Y-12)
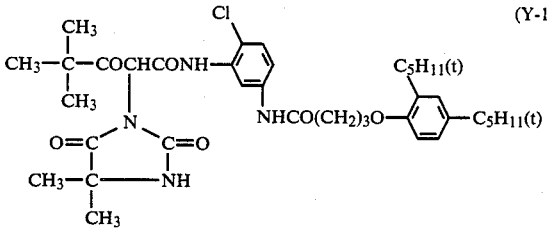
(Y-13)
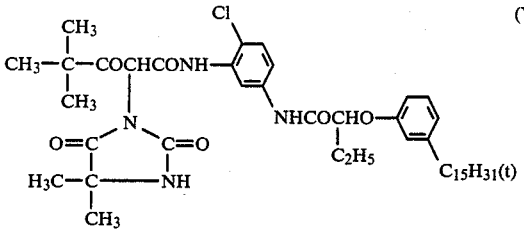
(Y-14)
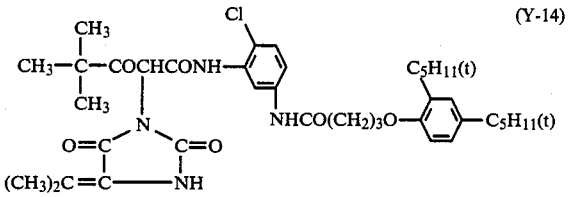
-continued
(Y-15)
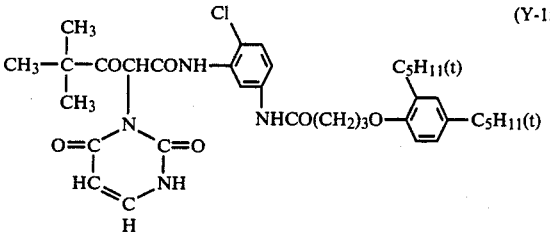
(Y-16)
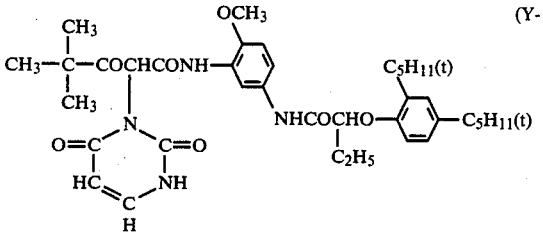
(Y-17)
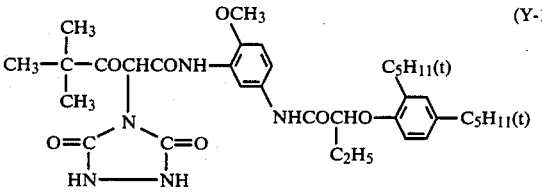
(Y-18)
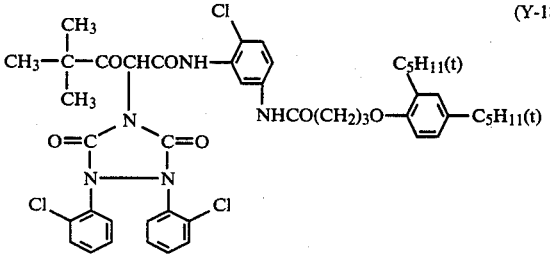
(Y-19)
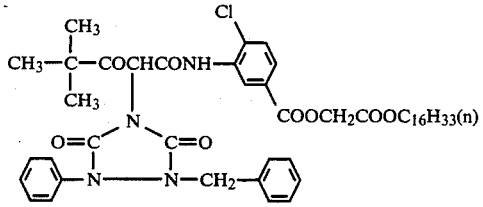
(Y-20)
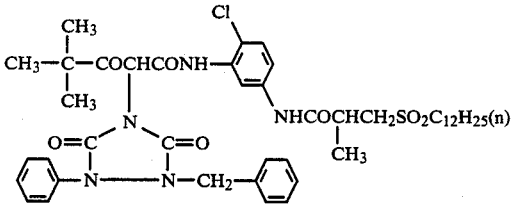
(Y-21)
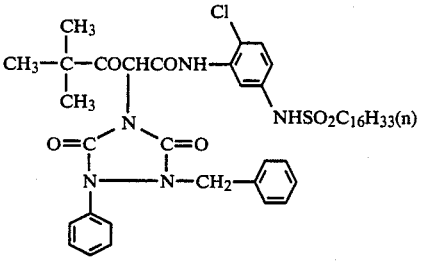

-continued
(Y-22)
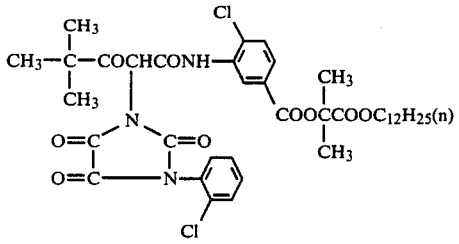
(Y-23)
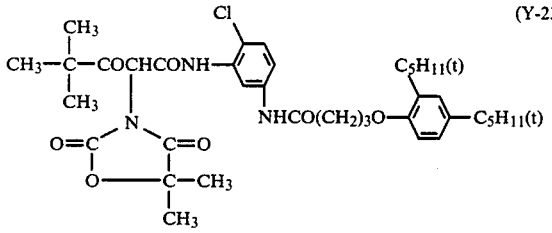
(Y-24)
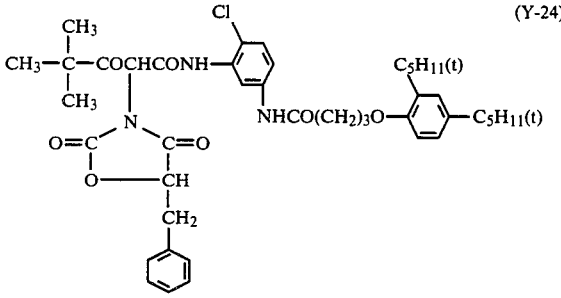
(Y-25)
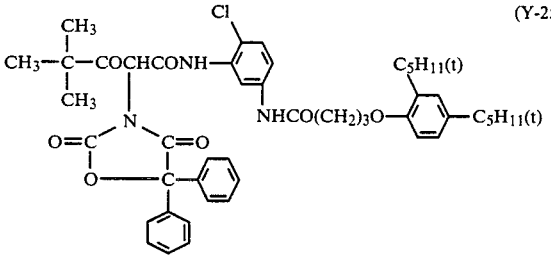
(Y-26)
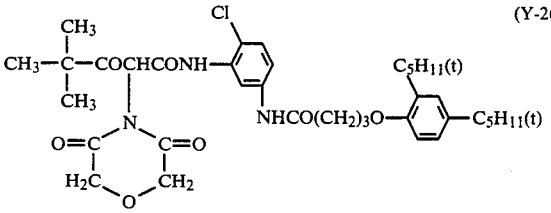
(Y-27)
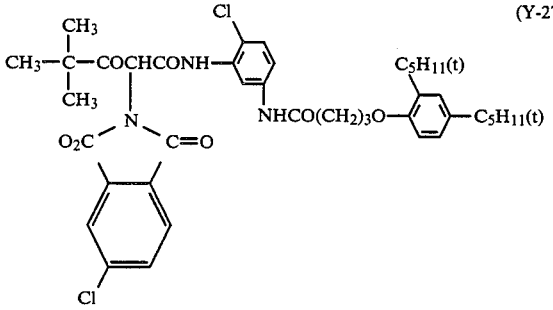
-continued
(Y-28)
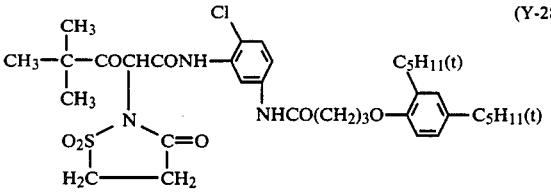
(Y-29)
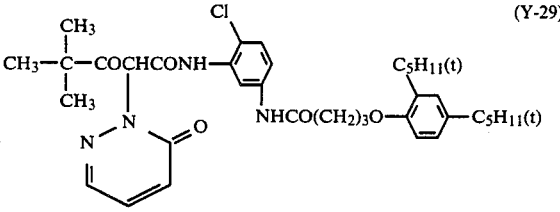
(Y-30)
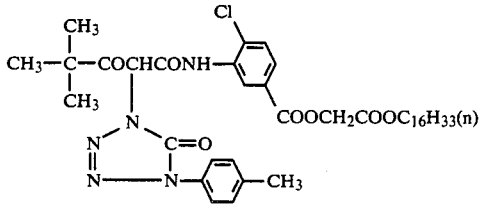
(Y-31)
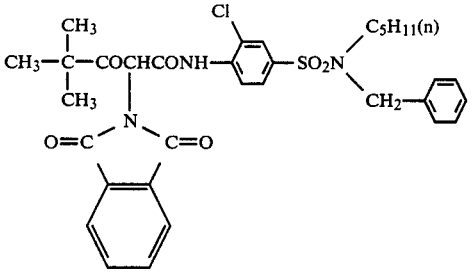
(Y-32)
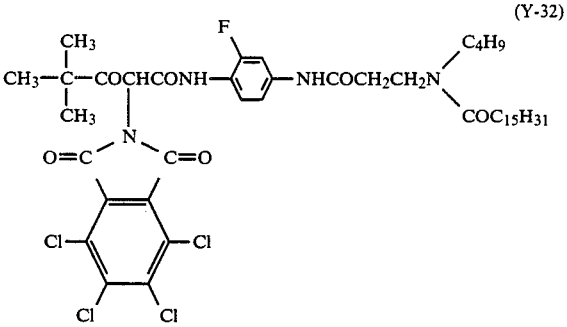
(Y-33)
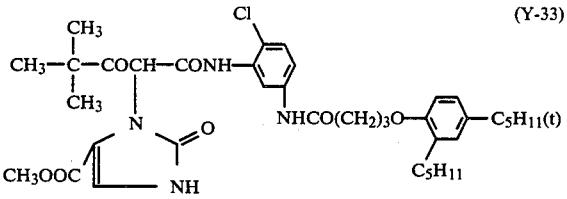
These yellow couplers can be synthesized by various methods disclosed in West German Patent Disclosure No. 2,057,941 and No. 2,163,812, Japanese Patent Application Laid-open SHO 47(1972)-26133, SHO 48(1973)-29432, SHO 50(1975)-65231, SHO 51(1976)-3631, SHO 51(1976)-50734, and SHO 51(1976)-102636, Japanese Patent Publication SHO 51(1976)-33410, Japanese Patent Application Laid-open SHO 48(1973)-66835, SHO 48(1973)-94432, SHO 49(1974)-1229, and SHO 49(1974)-10736, and Japanese Patent Publication SHO 52(1977)-25733.

Optionally, these couplers may be used in combination with other yellow couplers.

The magenta coupler to be used in the present invention is desired to be a compound represented by the general formula [VI] indicated below.

General formula [VI]

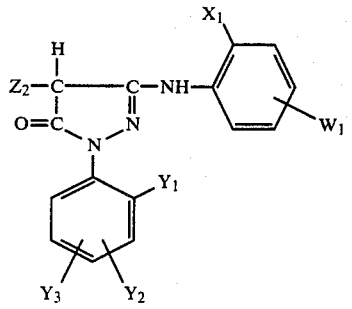

[wherein $X_1$ denotes a hydrogen atom, a halogen atom, or an alkoxy group having 1 to 4 carbon atoms, $Y_1$, $Y_2$, and $Y_3$ independently denote a hydrogen atom, a halogen atom, an alkyl group, an alkoxy group, a carboxy group, an alkoxycarbonyl group, a nitro group, an aryloxy group, a cyano group, or an acylamino group, $W_1$ denotes a

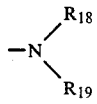

group (where $R_{18}$ and $R_{19}$ independently denote a hydrogen atom or an acyl group, on condition that where both $R_{18}$ and $R_{19}$ are acyl groups, they may be connected to each other to form a five-member hetero ring in conjunction with an N atom), an alkyl or aryl sulfonamide group, an alkyl or aryl sulfamoyl group, or an alkyl or aryl carboxylic ester group, and $Z_2$ denotes a hydrogen atom or a group eliminable by coupling].

To be more specific about the aforementioned general formula [VI], $W_1$ denotes a hydrogen atom, a halogen atom, or a monovalent organic group. Examples of the monovalent organic group include nitro group, alkyl group, alkoxy group, acylamino group, and sulfonamide group. Other examples are alkylcarbamoyl group, alkylsulfamoyl group, arylsulfamoyl group, alkylsuccinic acid imide group, alkoxycarbamide group, alkoxycarboalkylamino group, aralkoxycarboalkylamino group, alkyklaminocarboalkylamino group, and arylaminocarboalkylamino group which all may possess a substituent.

Optionally, $Z_2$ may be an atom or a group which is eliminable by any of various forms of coupling known to the art.

Now, typical concrete examples of the magenta coupler represented by the general formula [VI] will be cited below.

(VI-1)

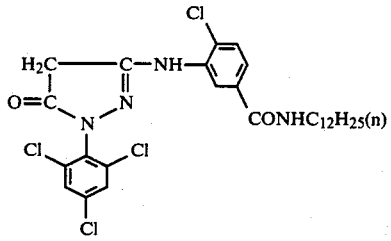

(VI-2)

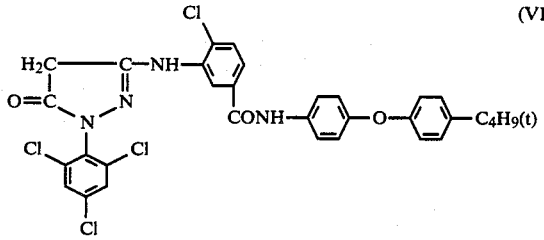

(VI-3)

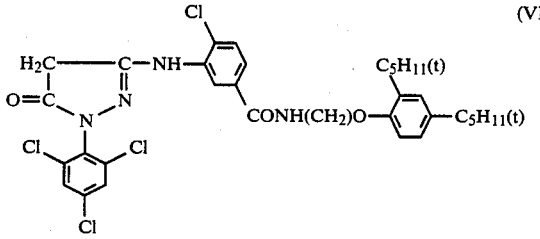

(VI-4)

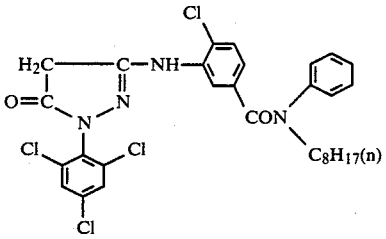

(VI-5)

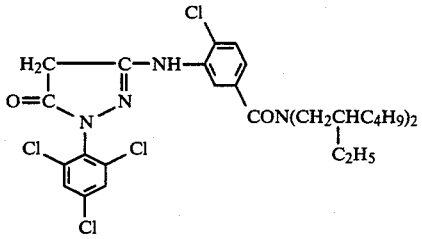

(VI-6)

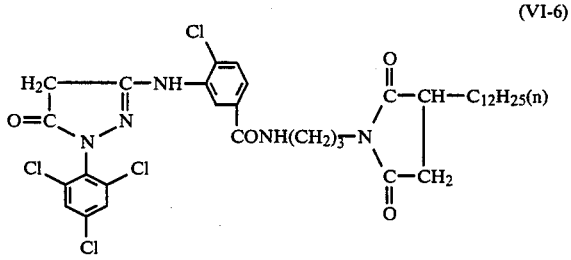

-continued
(VI-7)
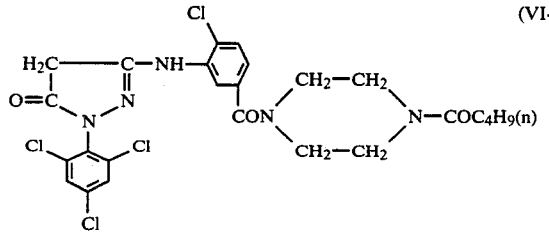
(VI-8)
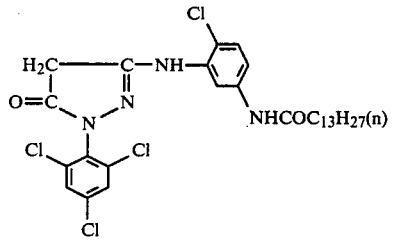
(VI-9)
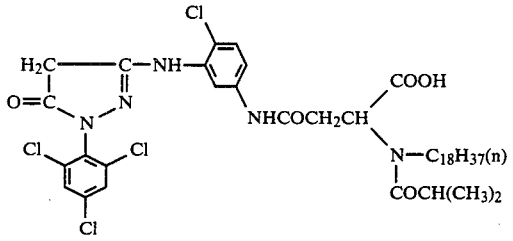
(VI-10)
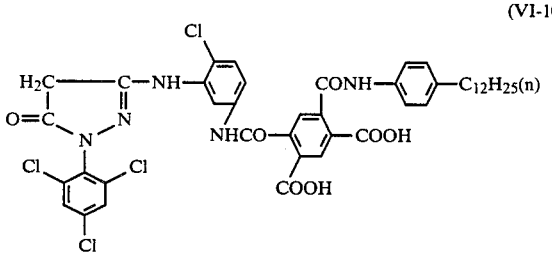
(VI-11)
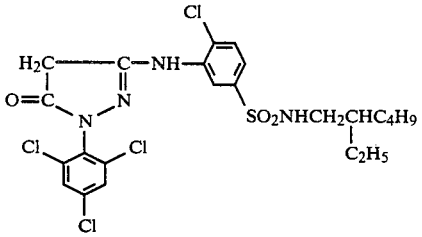
(VI-12)
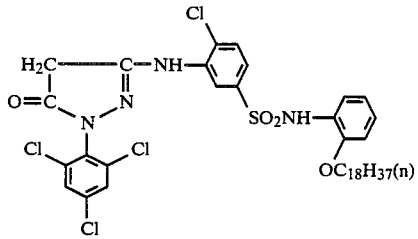
-continued
(VI-13)
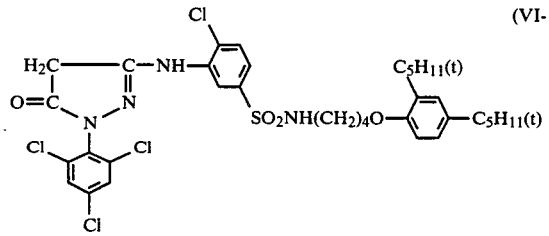
(VI-14)
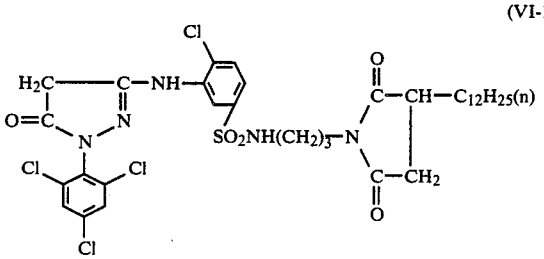
(VI-15)
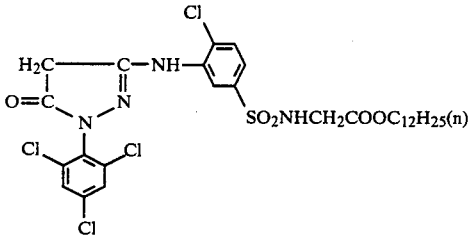
(VI-16)
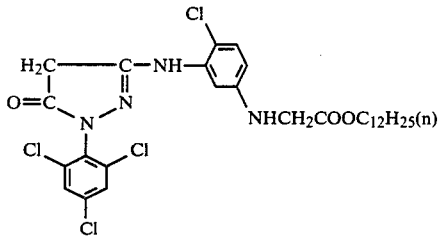
(VI-17)
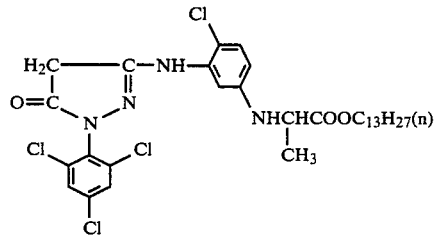
(VI-18)
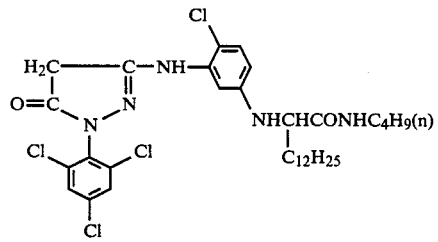

-continued
(VI-19)
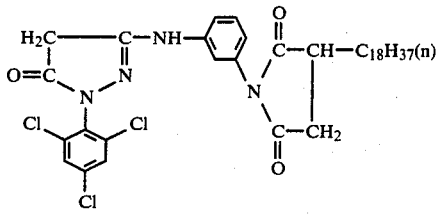
(VI-20)
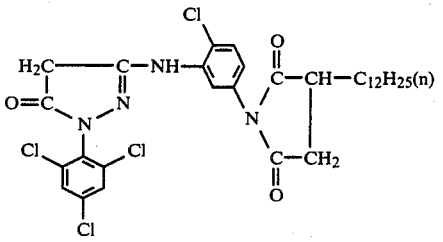
(VI-21)
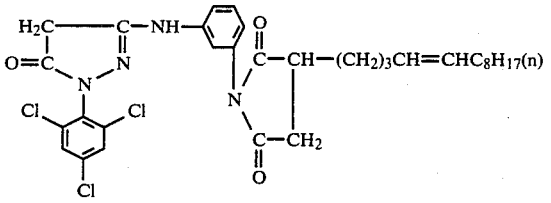
(VI-22)
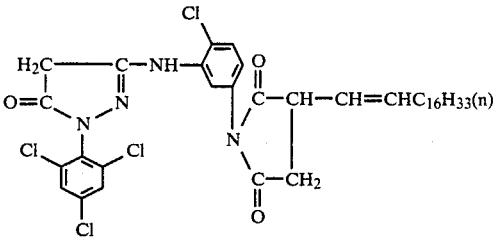
(VI-23)
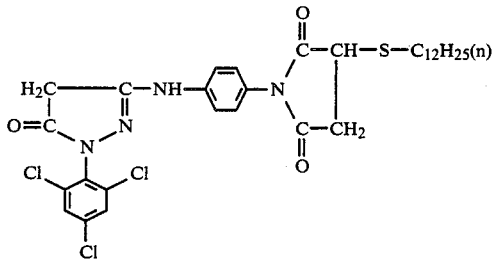
(VI-24)
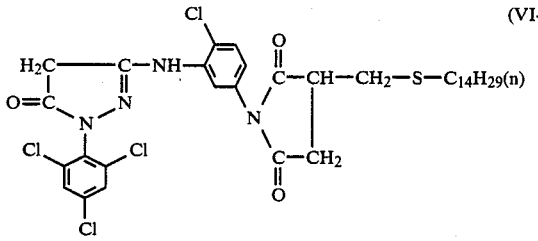
-continued
(VI-25)
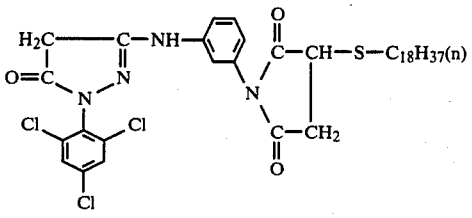
(VI-26)
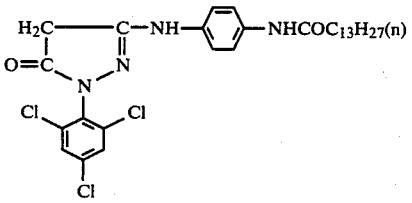
(VI-27)
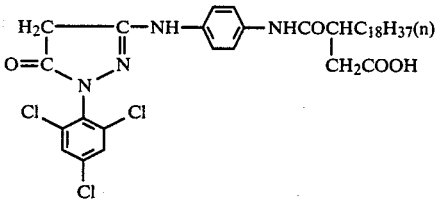
(VI-28)
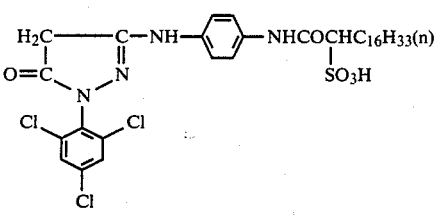
(VI-29)
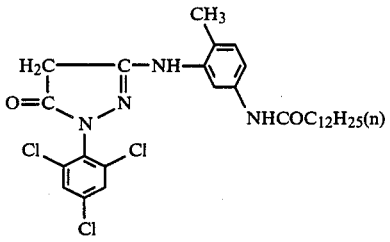
(VI-30)
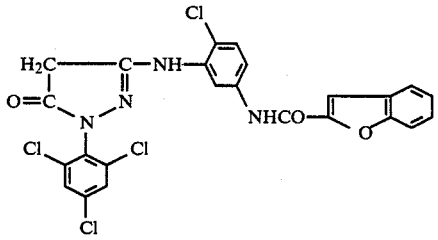

-continued
(VI-31)
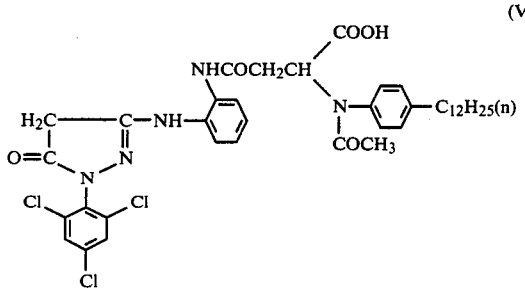
(VI-32)
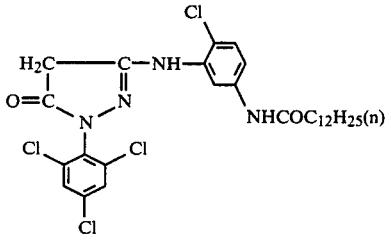
(VI-33)
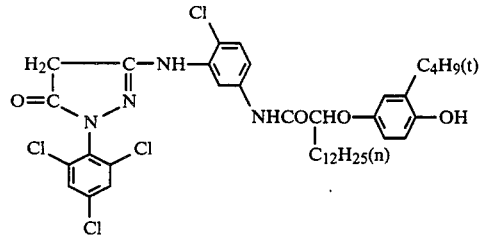
(VI-34)
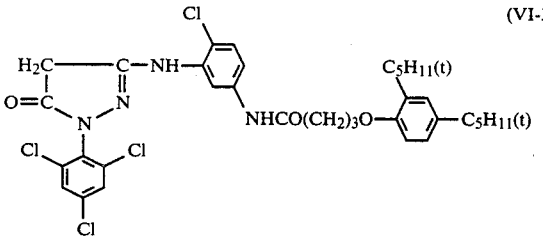
(VI-35)
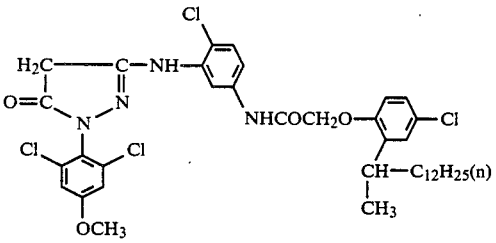
(VI-36)
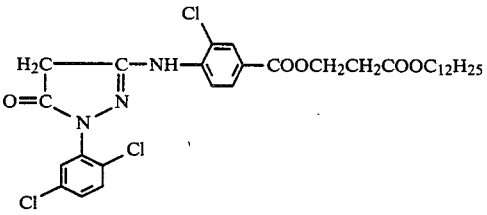
-continued
(VI-37)
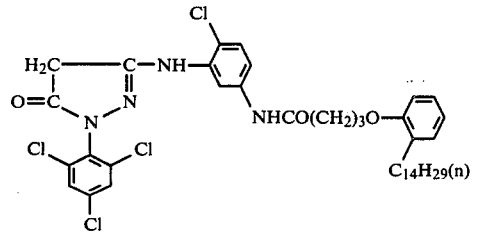
(VI-38)
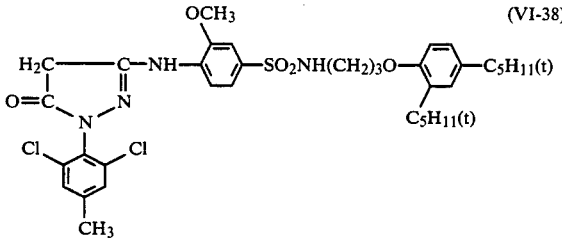
(VI-39)
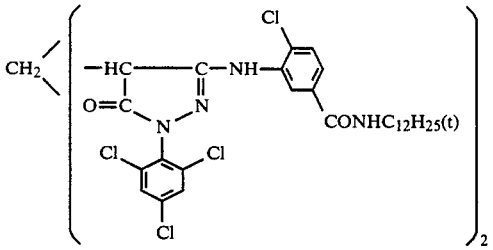
(VI-40)
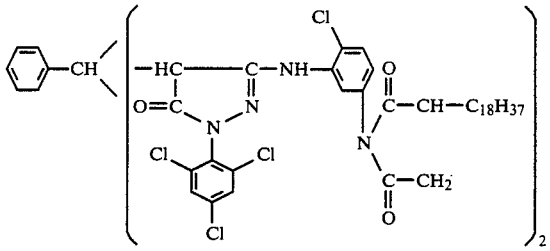
(VI-41)
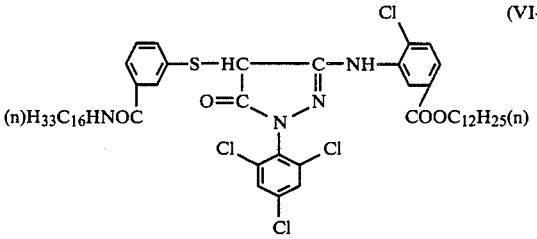
(VI-42)
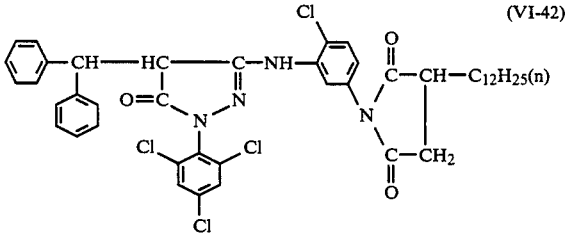

-continued (VI-43)

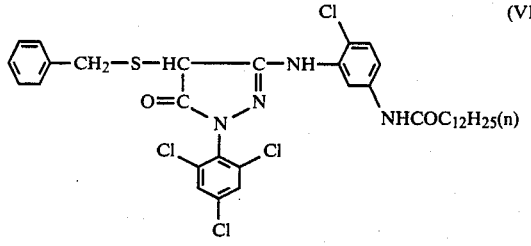

(VI-44)

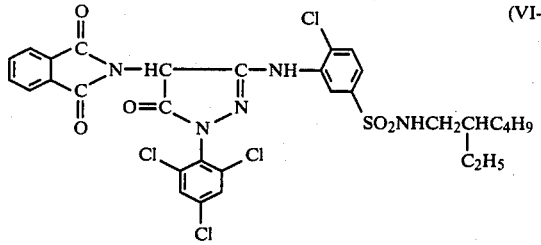

(VI-45)

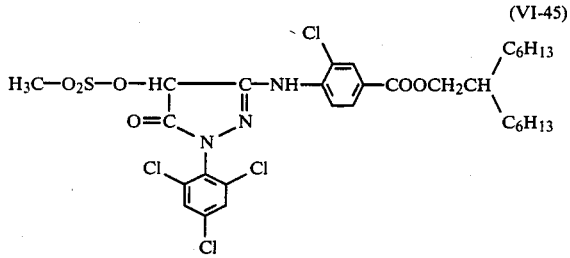

The magenta couplers enumerated above can be synthesized by various methods described in U.S. Pat. No. 3,684,514, British Pat. No. 1,183,515, Japanese Patent Publication SHO 40(1965)-6031, SHO 40(1965)-6035, SHO 44(1969)-15754, SHO 45(1970)-40757, and SHO 46(1971)-19032, and Japanese Patent Application Laid-open SHO 50(1975)-13041, SHO 53(1978)-129035, SHO 51(1976)-37646, and SHO 55(1980)-62454.

The yellow coupler and the magenta coupler described above are contained in the silver halide emulsion layer in an amount of about 0.05 to 2 mols, per mol of silver halide.

Incorporation of the yellow coupler and the magenta coupler described above in the emulsion can be effected by any of the conventionally known methods which have been described with respect to the cyan coupler above.

Examples of the substrate to be used in the present invention include baryta paper, polyethylene-coated paper, polypropylene paper, a transparent support provided with a reflecting layer or incorporating a reflecting member in combination, a glass sheet, films of such polyesters as cellulose acetate, cellulose nitrate, and polyethylene terephthalate, polyamide film, polycarbonate film, and polystyrene film. These substrates are suitably selected to meet the purposes for which the silver halide photographic sensitive material of this invention is used.

The silver halide emulsion layer and the non-sensitive layers to be used in this invention are applied to the substrate by any of the various methods known to the art, such as application by dipping, application with an air doctor, application with a curtain, and application with a hopper.

The silver halide to be used in the silver halide emulsion according with this invention may be any of the silver halides generally used in silver halide emulsions of ordinary run, such as silver bromide, silver chloride, silver iodobromide, silver chlorobromide, and silver chloroiode. The silver halide particles may be coarse or extremely fine. No limit is set to the particle size distribution.

These silver halide particles may be normal crystals or twins. The ratio between the (100) planes and the (111) planes does not matter at all. The crystalline structure of these silver halide particles may be uniform of not uniform inside and outside the stratal depth. The silver halide may be of a type capable of forming latent image mainly on the surface of its particles or of a type capable of forming latent image inside the particles. Further, the silver halide can be produced by any of the neutral method, the ammonia method, and the acidic method. The silver halide particles produced by any of the simultaneous mixing method, the sequential mixing method, the reversed mixing method, and the conversion method are similarly usable.

The silver halide emulsion according with this invention can be chemically sensitized by the use of a sensitizer added thereto. Examples of the sensitizer include sulfur sensitizers such as arylthiocarbamide, thiourea, and cystine, active and inactive selenium sensitizers, reducing sensitizers such as stannous salts and polyamines, noble metal sensitizers including gold sensitizers such as potassium aurithiocyanate, potassium chloroaurate, and 2-aurosulfonbenzthiazole methyl chloride, and sensitizers of water-soluble salts of ruthenium, iridium, etc. such as ammonium chloropalladate, potassium chloroplatinate, and sodium chloropalladide. These sensitizers can be used either singly or in a suitably combined form.

The silver halide emulsion according with this invention can contain any of various photographic additives known to the art. Examples of these photographic additives are enumerated in "Research Disclosure," December 1978, No. 17643, for instance.

The silver halide according with this invention is spectrally sensitized by the selection of a suitable sensitizing coloring matter for the purpose of conferring sensitivity in the sensitive wavelength zone necessary for the red sensitive emulsion. Various spectrally sensitizing coloring matters are known to the art. They can be used either singly or in a suitably combined form.

As spectrally sensitizing coloring matters advantageously usable for this invention, cyanine dyes, merocyanine dyes, and composite cyanine dyes disclosed in the specifications of U.S. Pat. Nos. 2,269,234, 2,270,378, 2,442,710, and 2,776,280 may be cited, for example.

The silver halide emulsion layer and non-sensitive layers in the silver halide color photographic sensitive material of the present invention can contain various other photographic additives. Examples of these additives include anti-fogging agent, color stain preventing agent, fluorescent whitening agent, antistatic agent, hardening agent other than the hardening agent indispensable to the construction of this invention, plasticizer, wetting agent, color image stabilizer, dyes for preventing halation or irradiation, and ultraviolet light absorbent.

Incorporation of the cyan coupler according with this invention, the aforementioned yellow coupler and magenta coupler, and other oil-soluble substances such as ultraviolet light absorbent and oil-soluble dyes in the emulsion layers and in other photographic layers using hydrophilic colloids as a binder can be effected by any of the methods known to the art. For example, this incorporation may be obtained by dissolving the couplers and other substances either independently or collectively as mixed in at least one high boiling organic solvent, optionally with a low boiling solvent used as a solution aid, dispersing the resultant solution in an aqueous solution of a hydrophilic colloid (such as gelatin) containing a surfactant, and adding the resultant emulsion to the hydrophilic solution prepared to form the photographic layer.

The high boiling solvent to be used as described above heavily affects the photographic properties. Where importance is attached to the color developing property of the photographic layer coated with a coupler dispersion, it is desirable to use a high boiling organic solvent having a dielectric constant exceeding 6.1 (30° C.). Where importance is placed in the image preserving property (fading property), a high boiling solvent having a dielectric constant of less than 6.1 (30° C.) is used advantageously.

Examples of the high boiling organic solvent desirably used include phthalic esters, phosphoric esters and other esters, organic amides, ketones, and hydrocarbons. These high boiling organic solvents are desired to possess vapor pressure of not more than 0.5 mmHg at 100° C. Particularly desirable examples are phthalic esters represented by the general formula [VII] and phosphoric esters represented by the general formula [VIII] both indicated below.

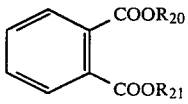

General formula [VII]

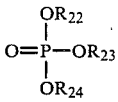

General formula [VIII]

[wherein $R_{20}$ and $R_{21}$ independently denote an alkyl group, an alkenyl group, or aryl group each having 16 to 32 carbon atoms, preferably 16 to 24 carbon atoms and $R_{22}$, $R_{23}$, and $R_{24}$ independently denote an alkyl group, an alkenyl group, or an aryl group, each having 24 to 54 carbon atoms].

In contrast, high boiling organic solvents having a dielectric constant exceeding 6.1 are compounds of the general formula [VII] wherein $R_{20}$ and $R_{21}$ independently denote an alkyl group of 1 to 4 carbon atoms and compounds of the general formula [VIII] wherein $R_{22}$, $R_{23}$, and $R_{24}$ independently denote an alkyl group of 1 to 4 carbon atoms or an aryl group which may possess a substituent.

The high boiling organic solvent is used in an amount accounting for 25 to 150% by weight, preferably 50 to 100% by weight, based on the coupler, for example.

Now, concrete examples of the high boiling organic solvent to be advantageously used in this invention will be cited. They are not exclusive examples. High boiling solvents of another type include diethyl maleate, diethyl malonate, γ-butyrolactone, methyl benzoate, benzyl alcohol, and 1-octanol.

Concrete Examples of high boiling solvent:

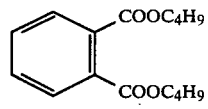

(VII-1)

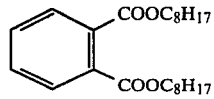

(VII-2)

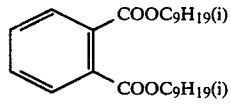

(VII-3)

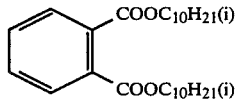

(VII-4)

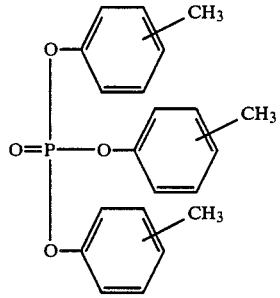

(VIII-1)

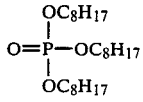

(VIII-2)

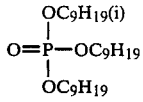

(VIII-3)

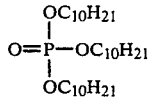

(VIII-4)

In this invention, desired improvement in the fading property of image can be attained by selecting the aforementioned high boiling solvent. More active improvement of the fading property can be attained by using a color image stabilizer represented by the general formula [IX] or the general formula [X] indicated below.

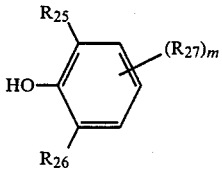

General formula [IX]

[wherein $R_{25}$ and $R_{26}$ independently denote an alkyl group, $R_{27}$ denotes a hydrogen atom, an alkyl group, a —$NR'_{27}R''_{27}$ group, a —$SR'_{27}$ group, or a —$COOR''_{27}$ group (where $R'_{27}$ denotes a monovalent organic group and $R''_{27}$ denotes a hydrogen atom or a monovalent organic group), and m denotes an integer of 0 to 3].

General formula [X]

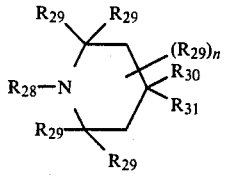

[wherein $R_{28}$ denotes a hydrogen atom, a hydroxyl group, an oxy radical group (—O group), a —$SOR'_{28}$ group, a —$SO_2R''_{28}$ group (where $R'_{28}$ and $R''_{28}$ independently denote a monovalent organic group), an alkyl group, an alkenyl group, an alkinyl group, or a —$COR'''_{28}$ group (where $R'''_{28}$ denotes a hydrogen atom or a monovalent organic group), $R_{29}$ denotes an alkyl group, $R_{30}$ and $R_{31}$ independently denote a hydrogen atom or a OCOR' group (where R' denotes a monovalent organic group) or $R_{30}$ and $R_{31}$ may jointly form a heterocyclic group, and n denotes an integer of 0 to 4].

The alkyl groups denoted by the symbols of $R_{25}$ and $R_{26}$ in the aforementioned general formula [IX] are desired to be alkyl groups of 1 to 12 carbon atoms, preferably alkyl groups of 3 to 8 carbon atoms branched to the α position. In all the alkyl groups denoted by $R_{25}$ and $R_{26}$, t-butyl group or t-pentyl group proves particularly desirable.

The alkyl groups denoted by $R_{27}$ are straight or branched alkyl groups such as, for example, methyl group, ethyl group, propyl group, butyl group, pentyl group, octyl group, nonyl group, dodecyl group, and octadecyl group. Where these alkyl groups are substituted, examples of the substituent include halogen atoms, hydroxy group, nitro group, cyano group, aryl groups (such as phenyl group, hydroxyphenyl group, 3,5-di-6-butyl-4-hydroxylphenyl group, and 3,5-di-t-pentyl-4-hydroxyphenyl group), amino groups (such as dimethylamino group, diethylamino group, and 1,3,5-triazinylamino group), alkyloxycarbonyl groups (such as methoxycarbonyl group, ethoxycarbonyl group, propyloxycarbonyl group, butoxycarbonyl group, pentyloxycarbonyl group, octyloxycarbonyl group, nonyloxycarbonyl group, dodecyloxycarbonyl group, and octadecyloxycarbonyl group), aryloxycarbonyl groups (such as phenoxycarbonyl group), carbamoyl groups (such as methylcarbamoyl group, ethylcarbamoyl group, propylcarbamoyl group, butylcarbamoyl group, heptylcarbamoyl group, and other alkylcarbamoyl groups, arylcarbamoyl groups including phenylcarbamoyl group, and cycloalkylcarbamoyl groups including cyclohexylcarbamoyl group), isocyanuryl group, and heterocyclic groups including 1,3,5-triazinyl group.

Examples of the monovalent organic groups denoted by $R'_{27}$ and $R''_{27}$ include alkyl groups (such as methyl group, ethyl group, propyl group, butyl group, amyl group, decyl group, dodecyl group, hexadecyl group, and octadecyl group), aryl groups (such as phenyl group and naphthyl group), cycloalkyl groups (such as cyclohexyl group), and heterocyclic grous (such as 1,3,5-triaxinyl group and isocyanuryl group). Where these organic groups are substituted, examples of the substituent include halogen atoms (such as fluorine, chlorine, and bromine), hydroxyl group, nitro group, cyano group, amino groups, alkyl groups (such as methyl group, ethyl group, i-propyl group, t-butyl group, and t-amyl group), aryl groups (such as phenyl group and tolyl group), alkenyl groups (such as allyl group), alkylcarbonyloxy groups (such asmethylcarbonyloxy group, ethylcarbonyloxy group, and benzylcarbonyloxy group), and arylcarbonyloxy groups (such as benzoyloxy group).

In this invention, the compounds denoted by the general formula [IX] are more desirably to be those compounds represented by the general formula [IX'] indicated below.

General formula [IX']

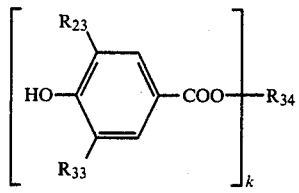

[wherein $R_{32}$ and $R_{33}$ independently denote a straight or branched alkyl group of 3 to 8 carbon atoms, preferably t-butyl group or t-pentyl group, $R_{34}$ denotes an organic group of a valence of k, where k denotes an integer of 1 to 6].

Examples of the organic group of a valence of k denoted by the symbol of $R_{34}$ include alkyl groups such as methyl group, ethyl group, propyl group, butyl group, pentyl group, octyl group, hexadecyl group, methoxyethyl group, chloromethyl group, 1,2-dibromomethyl group, 2-chloroethyl group, benzyl group, and phenethyl group, alkenyl groups such as allyl group, propenyl group, and butenyl group, polyvalent unsaturated hydrocarbon groups such as ethylene, trimethylene, propylene, hexamethylene, and 2-chlorotrimethylene, unsaturated hydrocarbons such as glyceryl, diglyceryl, pentaerythrityl, and dipentaerythrityl, alicyclic hydrocarbon groups such as cyclopropyl, cyclohexyl, and cyclohexenyl group, aryl groups such as phenyl group, p-octylphenyl group, 2,4-dimethylphenyl group, 2,4-di-t-butylphenyl group, 2,4-di-6-pentylphenyl group, p-chlorophenyl group, 2,4-dibromophenyl group, and naphthyl group, arylene groups such as 1,2-, 1,3-, or 1,4-phenylene group, 3,5-dimethyl-1,4-phenylene group, 2-t-butyl-1,4-phenylene group, 2-chloro-1,4-phenylene group, and naphthalene group, and 1,3,5-trisubstituted-benzene groups.

In addition to the groups enumerated above, $R_{34}$ embraces organic groups of a valence of k having any of the groups mentioned above linked thereto through the medium of —O—, —S—, or —$SO_2$— group.

Preferred examples of the group denoted by $R_{34}$ are 2,4-di-t-butylphenyl group, 2,4-di-t-pentylphenyl group, p-octylphenyl group, p-dodecylphenyl group, 3,5-di-t-butyl-4-hydroxyphenyl group, and 3,5-di-t-pentyl-4-hydroxyphenyl group.

Preferably, the symbol k denotes an integer of the value of 1 to 4.

Now, concrete examples of the compound represented by the general formula [IX] will be cited below. These are not exclusive examples.

(IX-1)

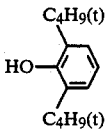

-continued
(IX-2)
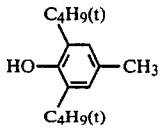
(IX-3)
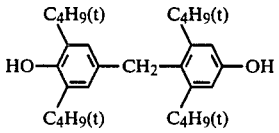
(IX-4)
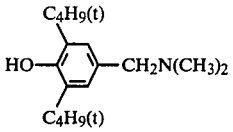
(IX-5)
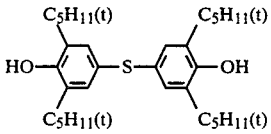
(IX-6)
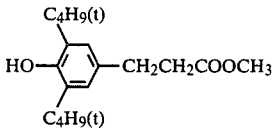
(IX-7)
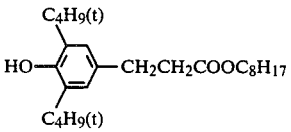
(IX-8)
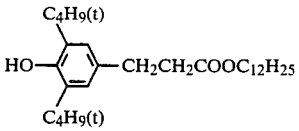
(IX-9)
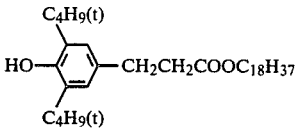
(IX-10)
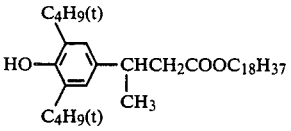
(IX-11)
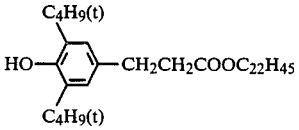
(IX-12)
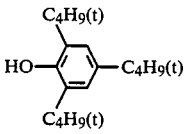
-continued
(IX-13)
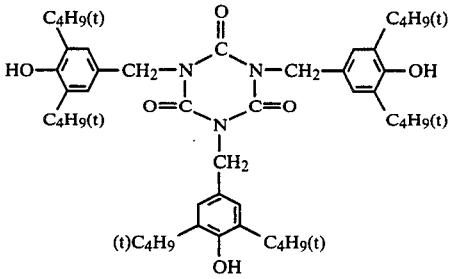
(IX-14)
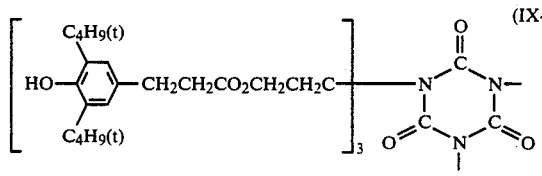
(IX-15)
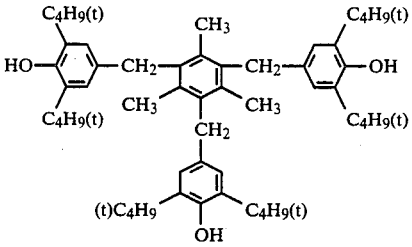
(IX-16)
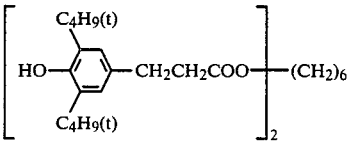
(IX-17)
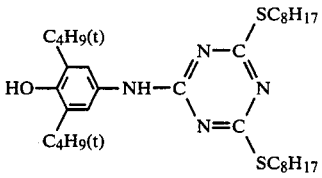
(IX-18)
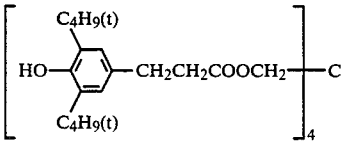
(IX-19)
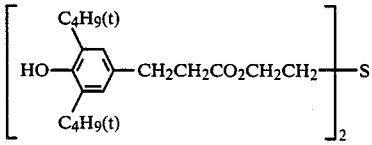
(IX-20)
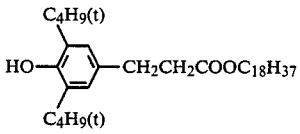

-continued
(IX-21)
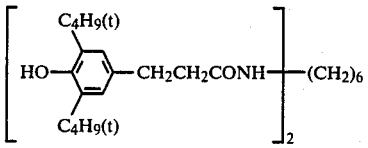
(IX-22)
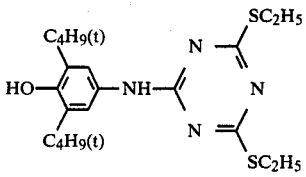
(IX-23)
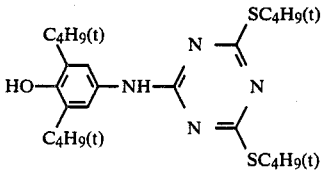
(IX-24)
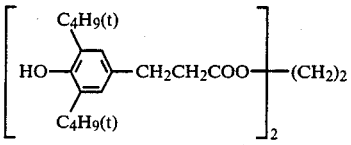
(IX-25)
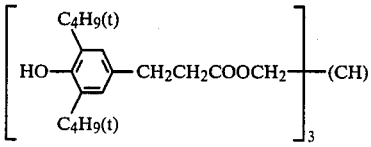
(IX-26)
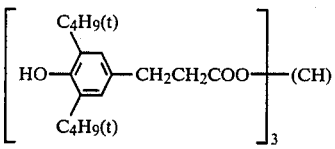
(IX-27)
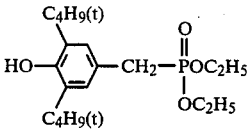
(IX-28)
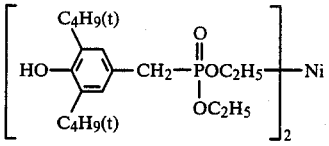
(IX-29)
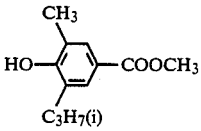
(IX-30)
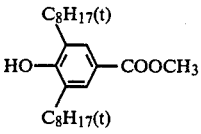
-continued
(IX-31)
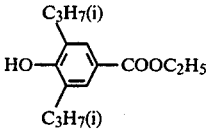
(IX-32)
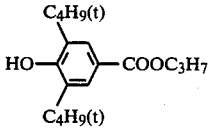
(IX-33)
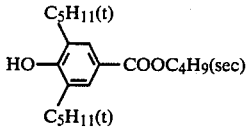
(IX-34)
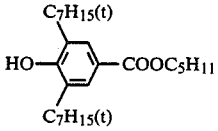
(IX-35)
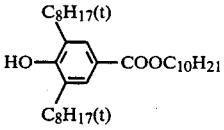
(IX-36)
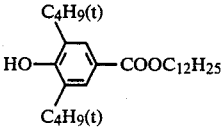
(IX-37)
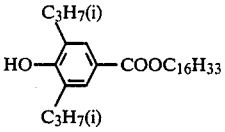
(IX-38)
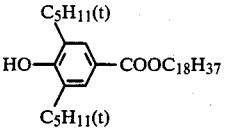
(IX-39)
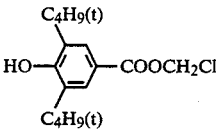
(IX-40)
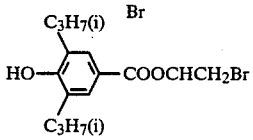
(IX-41)
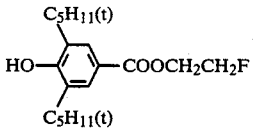

-continued
(IX-42)
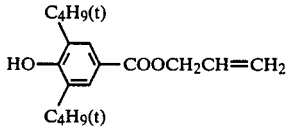
(IX-43)
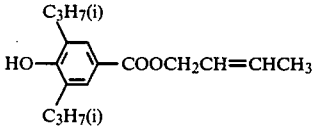
(IX-44)
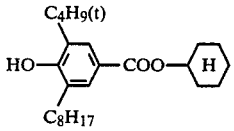
(IX-45)
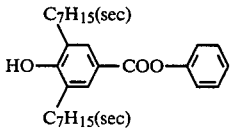
(IX-46)
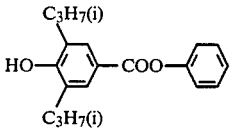
(IX-47)
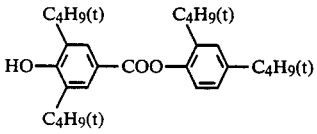
(IX-48)
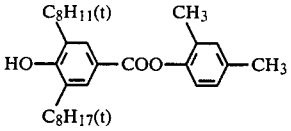
(IX-49)
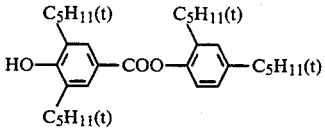
(IX-50)
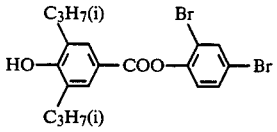
(IX-51)
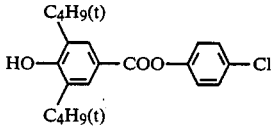
(IX-52)
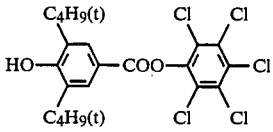
-continued
(IX-53)
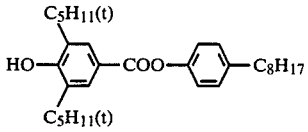
(IX-54)
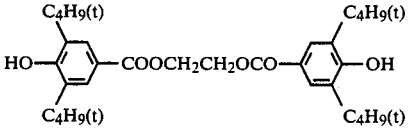
(IX-55)
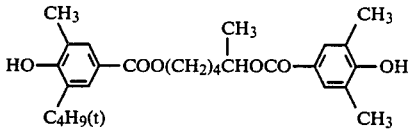
(IX-56)
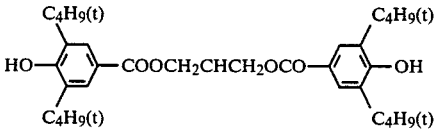
(IX-57)
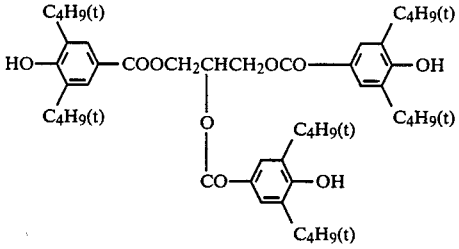
(IX-58)
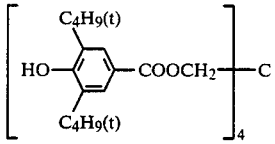
(IX-59)
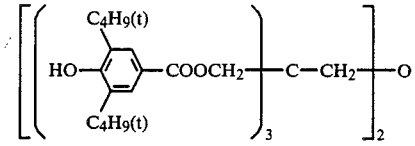
(IX-60)
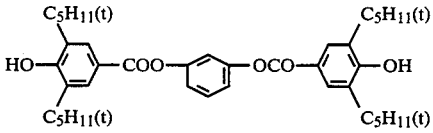
(IX-61)
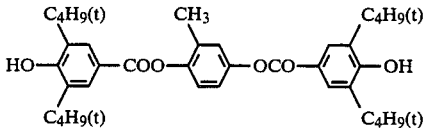
(IX-62)
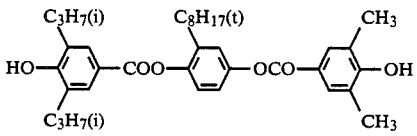

-continued
(IX-63)
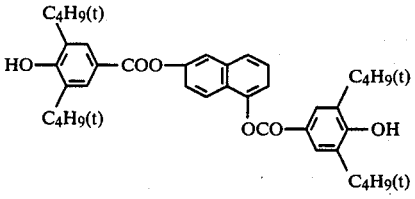
(IX-64)
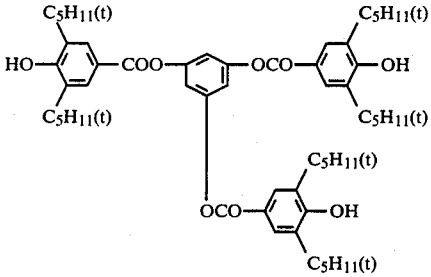
(IX-65)
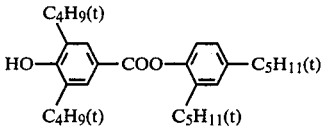
(IX-66)
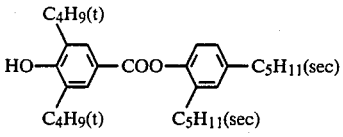
(IX-67)
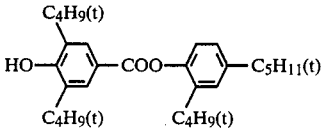
(IX-68)
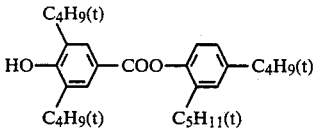
(IX-69)
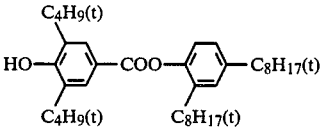
(IX-70)
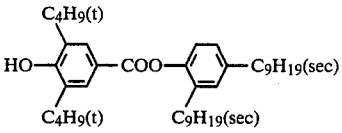
(IX-71)
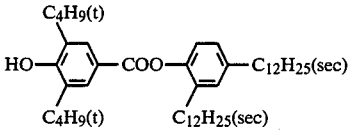
(IX-72)
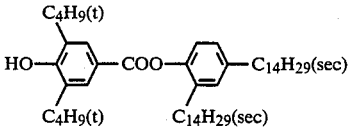
-continued
(IX-73)
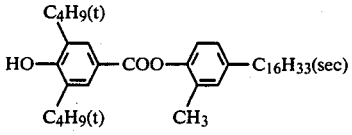
(IX-74)
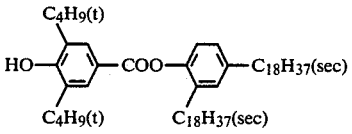
(IX-75)
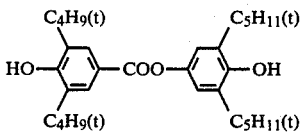
(IX-76)
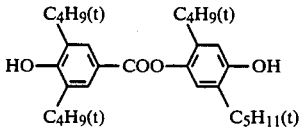
(IX-77)
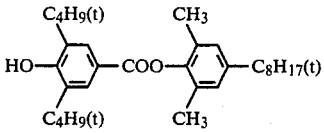
(IX-78)
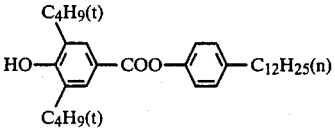
(IX-79)
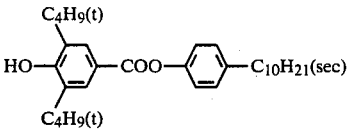
(IX-80)
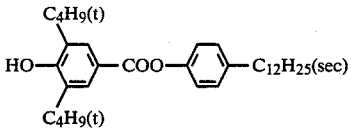
(IX-81)
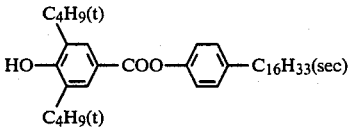
(IX-82)
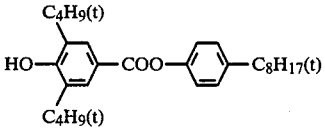
(IX-83)
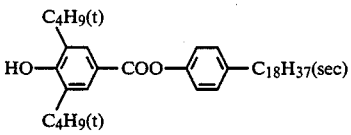

-continued (IX-84)

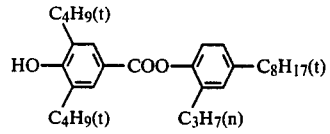

(IX-85)

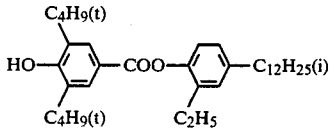

(IX-86)

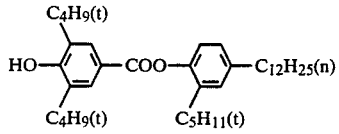

(IX-87)

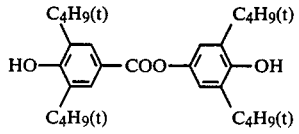

(IX-88)

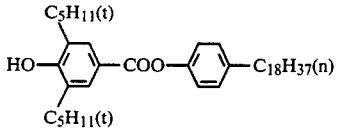

(IX-89)

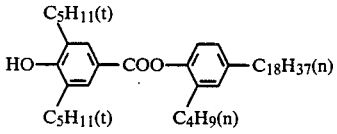

(IX-90)

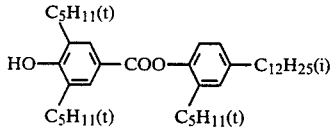

In the present inventionk the number of carbon atoms of the alkyl group denoted by the general formula [X] is desired to be 1 to 12. In the alkenyl group or alkinyl group similarly denoted by the same symbol, the number of carbon atoms is desired to be 2 to 4. Examples of the monovalent organic group denoted by each of the symbols $R'_{28}$, $R''_{28}$, and $R'''_{28}$ include alkyl groups, alkenyl groups, akinyl groups, and aryl groups. Examples of the desirable group denoted by the symbol $R_{28}$ include hydrogen atom, alkyl groups (such as methyl group, ethyl grup, propyl group, butyl group, chloromethyl group, hydroxymethyl group, and benzyl group), alkenyl groups (such as vinyl group, allyl group, and isopropenyl group), alkinyl groups (such as ethinyl group and propynyl group), and $—COR'''_{28}$ groups. Examples of the desirable group denoted by the symbol $R'''_{28}$ include alkyl groups (such as methyl group, ethyl group, propyl group, butyl group, and benzyl group), alkenyl groups (such as vinyl group, allyl group, and isopropenyl group), alkinyl groups (such as ethinyl group and propynyl group), and aryl groups (such as phenyl group and tolyl group).

Examples of the desirable group denoted by the symbol $R_{29}$ include straight and branched alkyl groups of 1 to 5 carbon atoms, preferably methyl group.

In the symbols $R_{30}$ and $R_{31}$, examples of the monovalent organic group denoted by the symbol R' include alkyl groups (such as methyl group, ethyl group, propyl group, butyl group, pentyl group, octyl group, dodecyl group, and octadecyl group), alkenyl groups (such as vinyl group), alkinyl groups (such as ethinyl group), aryl groups (such as phenyl group and naphthyl group), alkylamino groups (such as ethylamino group), and arylamino groups (such as anilino group). Examples of the heterocyclic group formed jointly by $R_{30}$ and $R_{31}$ are the groups of the following formulas.

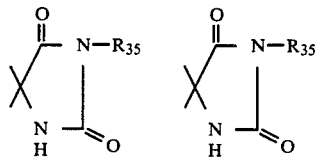

[wherein $R_{35}$ denotes a hydrogen atom, an alkyl group, a cycloalkyl group, or a phenyl group].

The compound represented by the general formula [X] in this invention is more desirably a compound represented by the following general formula [X]'.

General formula [X]'

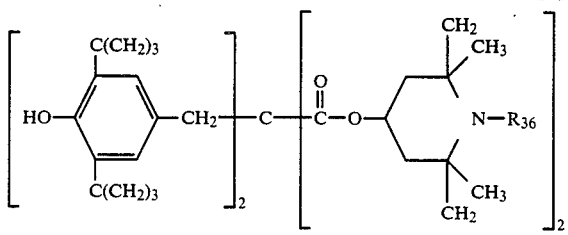

[wherein $R_{36}$ denotes one group selected from the class consisting of alkyl groups (such as methyl group, ethyl group, propyl group, butyl group, pentyl group, and benzyl group), alkenyl groups (such as vinyl group, allyl group, and isopropenyl group), alkinyl groups (such as ethinyl group and propynyl group), and acyl groups (such as formyl group, acetyl group, propionyl group, butylyl group, acryloyl group, propioloyl group, methacryloyl group, and crotonoyl group)].

Examples of the desirable group denoted by the symbol $R_{36}$ include methyl group, ethyl group, vinyl group, allyl group, propynyl group, benzyl group, acetyl group, propionyl group, acryloyl group, methacroyl group, and crotonoyl group.

Concrete examples of the compound represented by the general formula [X] will be cited below. These are not exclusive examples.

(X-1)

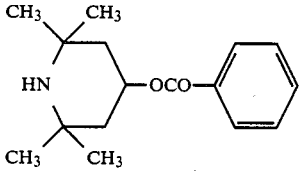

(X-2)

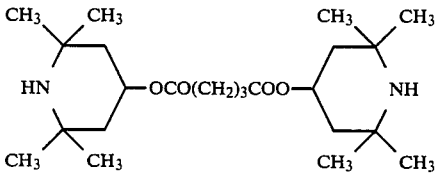

-continued
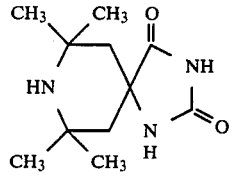
(X-3)
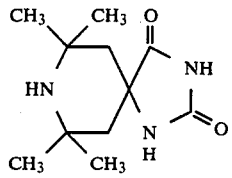
(X-4)
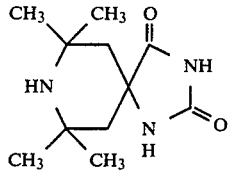
(X-5)
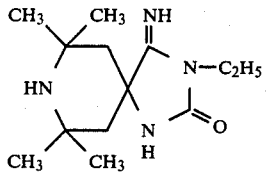
(X-6)
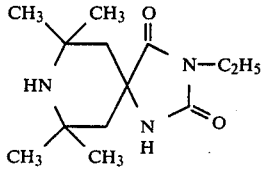
(X-7)
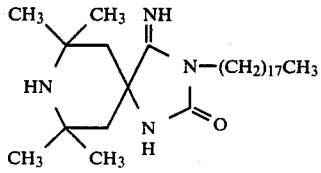
(X-8)
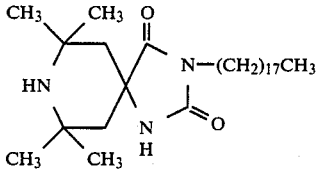
(X-9)
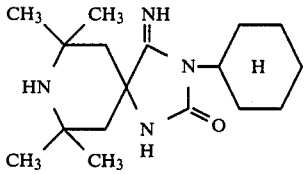
(X-10)
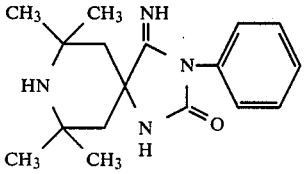
(X-11)
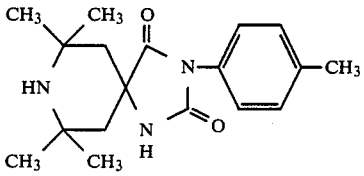
(X-12)
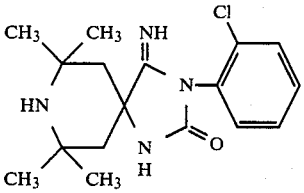
(X-13)
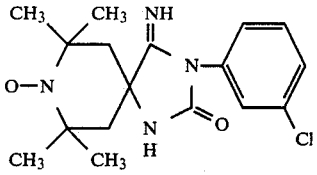
(X-14)
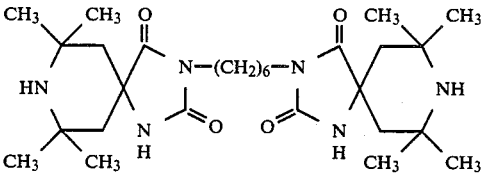
(X-15)
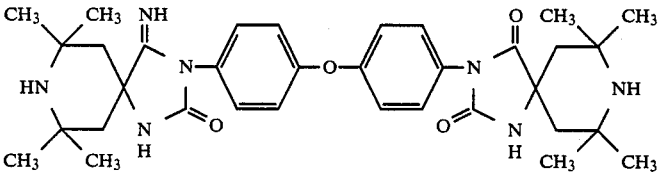
(X-16)
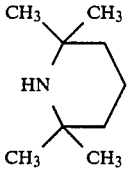
(X-17)
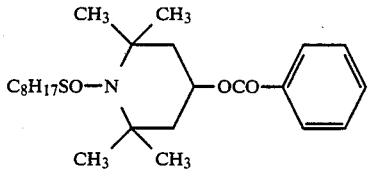
(X-18)

-continued
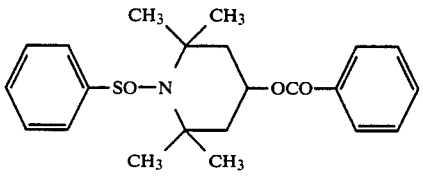
(X-19)
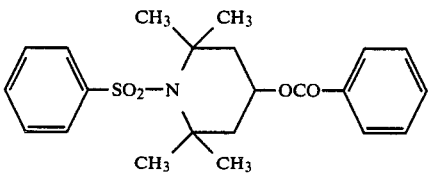
(X-20)
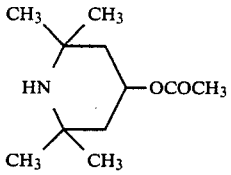
(X-21)
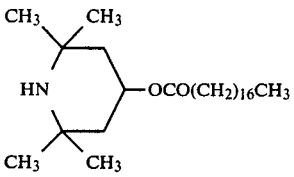
(X-22)
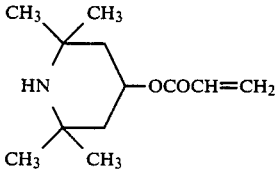
(X-23)
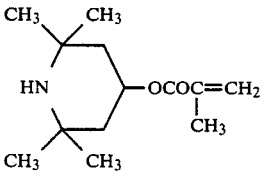
(X-24)
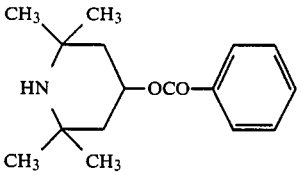
(X-25)
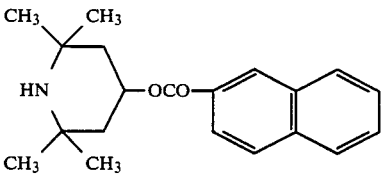
(X-26)
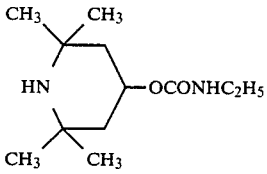
(X-27)
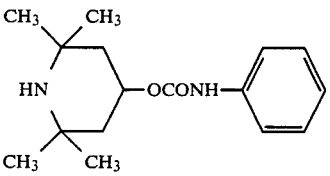
(X-28)
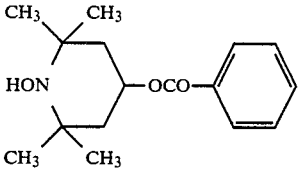
(X-29)
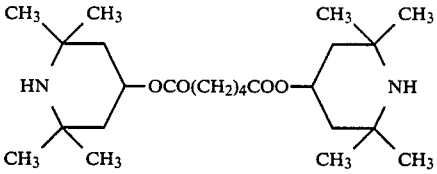
(X-30)
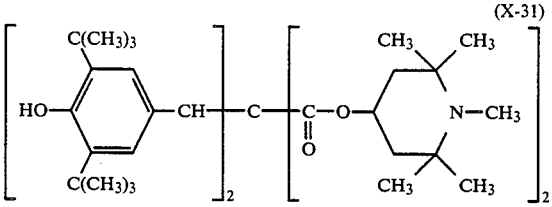
(X-31)
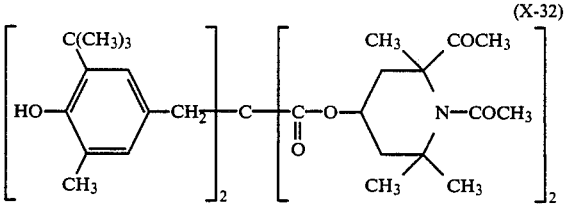
(X-32)
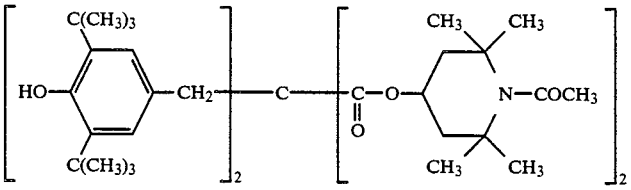
(X-33)

-continued
(X-34)
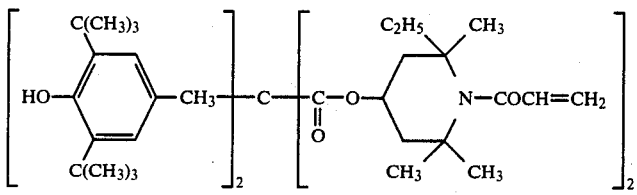
(X-35)
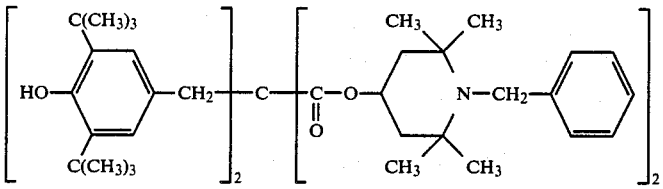
(X-36)
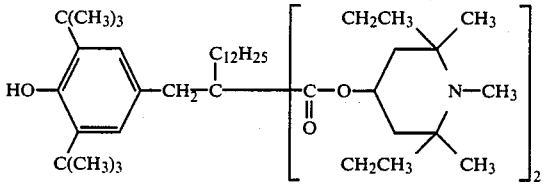
(X-37)
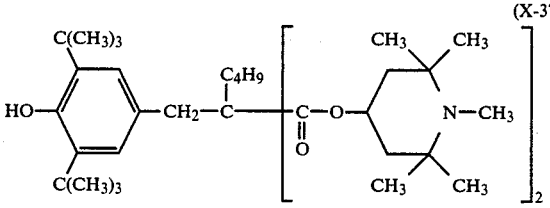
(X-38)
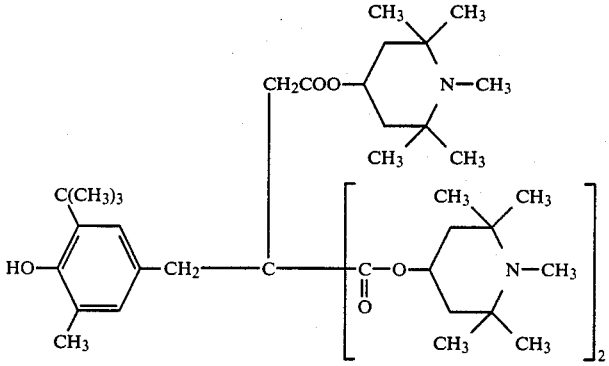
(X-39)
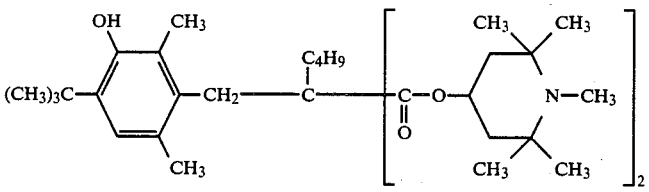
(X-40)
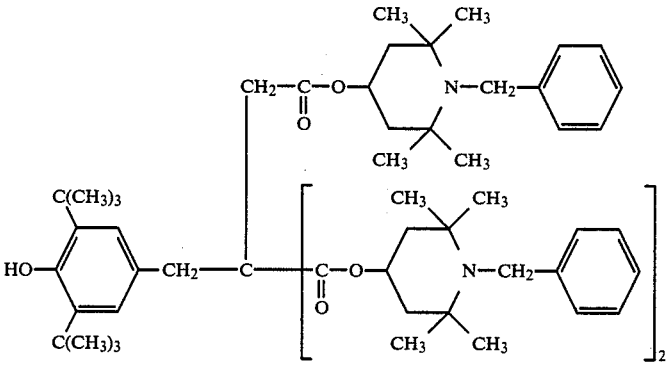

-continued
(X-41)
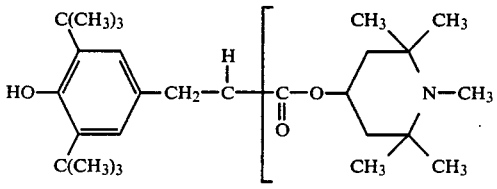
(X-42)
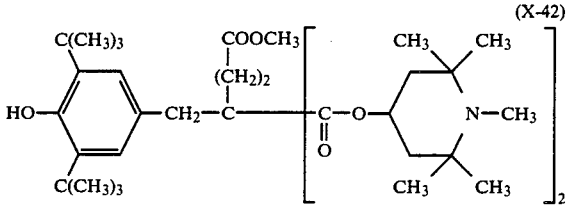
(X-43)
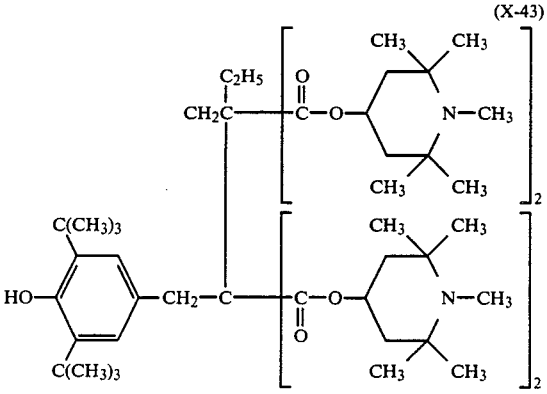
(X-44)
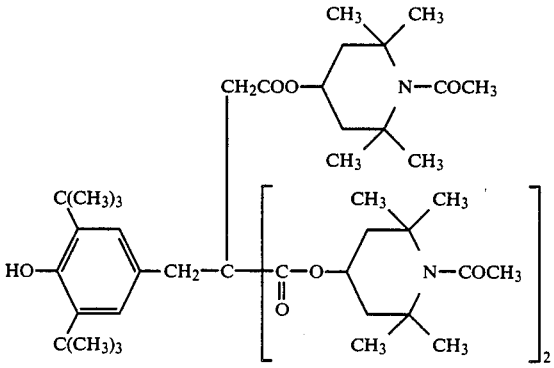
(X-45)
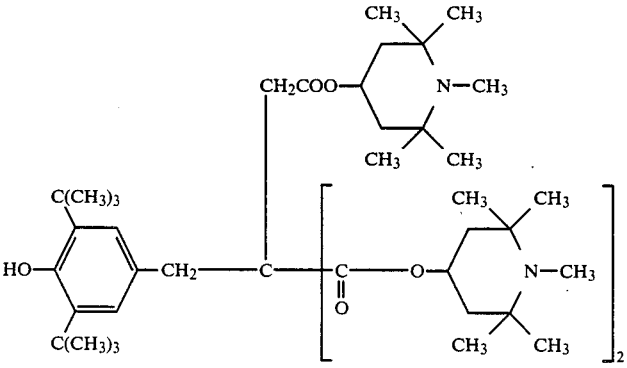
(X-46)
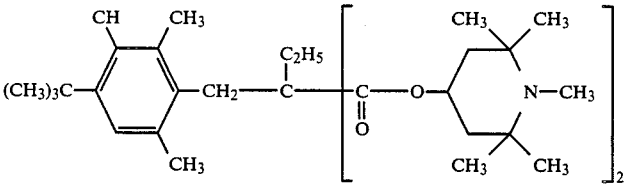
(X-47)
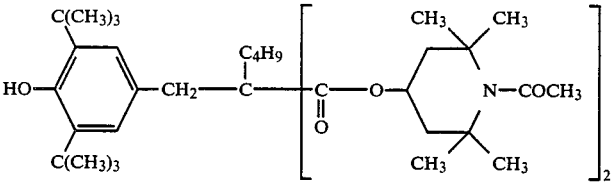
(X-48)
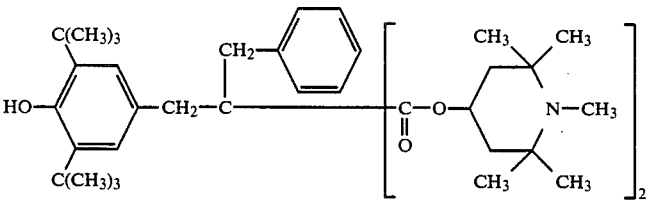

-continued
(X-49)
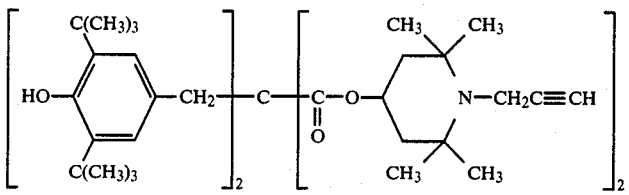
(X-50)
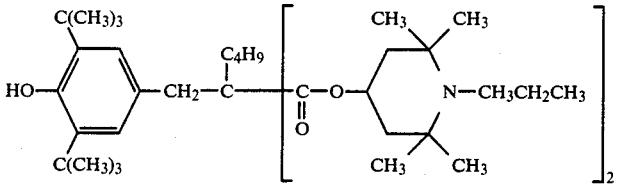
(X-51)
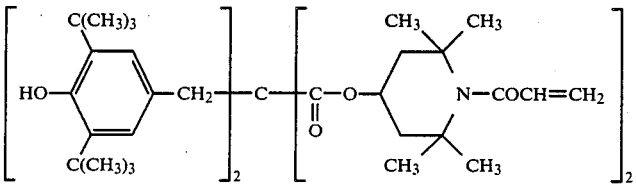
(X-52)
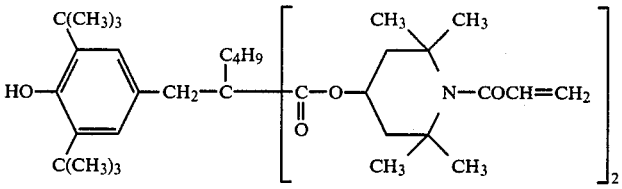
(X-53)
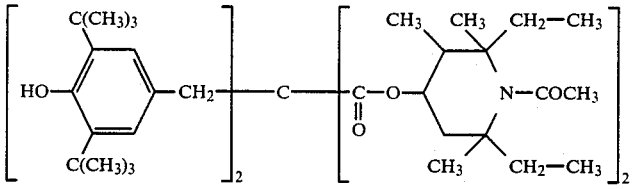
(X-54)
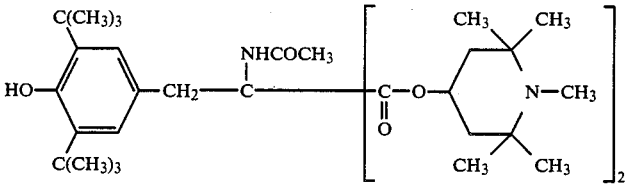
(X-55)
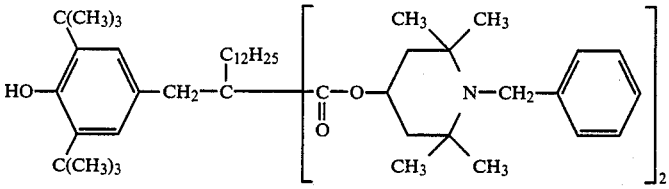
(X-56)
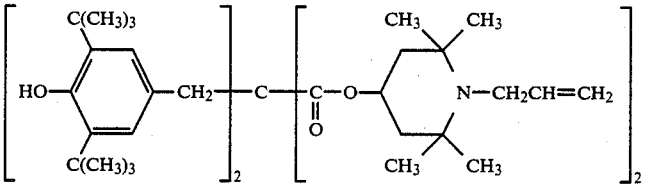

-continued

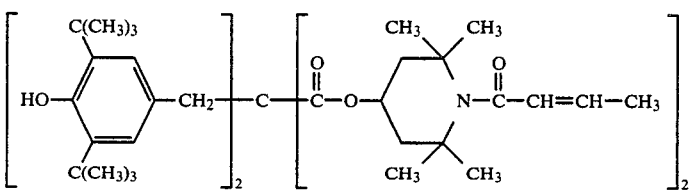

(X-57)

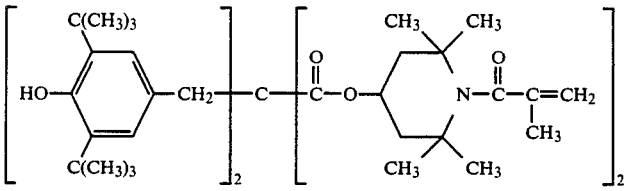

(X-58)

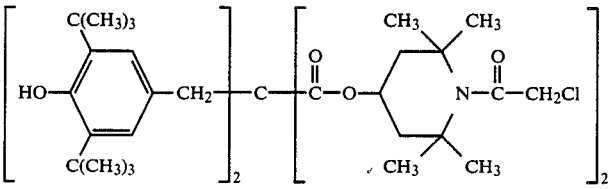

(X-59)

When the compounds of this invention represented by the general formulas [IX] and [X] are to be incorporated in the silver halide emulsion layer, they are desired to be used in a total amount of 5 to 300 parts by weight, preferably 10 to 100 parts by weight, based on 100 parts by weight of the cyan coupler according with this invention and other aforementioned couplers.

The compounds of the present invention represented by the general formulas [IX] and/or [X] are used desirably in combination with the yellow and magenta couplers. In this case, the total amount of these compounds may be substantially similar to that which is mentioned above relative to the cyan coupler according with this invention.

Further for the purpose of preventing irradiation and halation and enhancing the clearness and sharpness of the image, the emulsion layer (particularly red sensitive layer) may be imbued with a water-soluble or oil-soluble dye or provided with a halation preventing layer containing the dye.

The dye represented by the general formula [XI] and [XII] indicated below are water-soluble dyes usable advantageously for the purpose mentioned above.

General formula [XI]

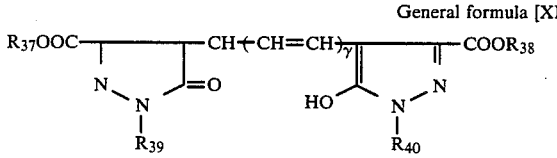

[wherein $R_{37}$ and $R_{38}$ independently denote a hydrogen atom, an alkyl group, or an aryl group, $R_{39}$ and $R_{40}$ independently denote an aryl group or a heterocyclic having at least one sulfonate group or carboxy group attached thereto either directly or through an alkylene group of 1 to 4 carbon atoms or a heterocyclic group, and $\gamma$ denotes an integer of the value of 0, 1, or 2].

General formula [XII]

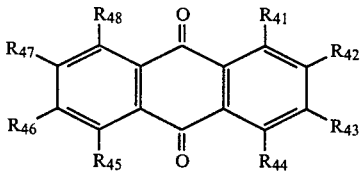

[wherein $R_{41}$, $R_{44}$, $R_{45}$, and $R_{48}$ independently denote a hydrogen atom, a hydroxy group, a $OR_o$ group (where $R_o$ denotes an alkyl group or an aryl group), a

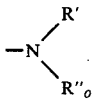

group (where $R'_o$ and $R''_o$ independently denote a hydrogen atom or an alkyl group or aryl group possessing at least one sulfonate group or carboxyl group), and $R_{42}$, $R_{43}$, $R_{46}$, and $R_{47}$ independently denote a hydrogen atom, a sulfonate group, a carboxyl group, or an alkyl group or aryl group possessing at least one sulfonate group or carboxyl group].

The dyes represented by the aforementioned general formula [XI] can be produced by the method of synthesis disclosed in Japanese Patent Publication SHO 51(1976)-46607 and SHO 39(1964)-22069, for example.

The dyes represented by the aforementioned general formula [XII] are also disclosed in the specification of U.S. Pat. No. 2,865,752. They can be produced by the method of synthesis disclosed in the specification of British Pat. No. 238,717 or the specification of German Pat. No. 462,041, for example.

From the dye, the photographic layer can be produced by dissolving the dye in water or in an organic solvent such as ethanol, methanol, or acetone which is miscible with water, adding the resultant solution to a hydrophilic colloidal binder capable of forming the aforementioned photographic layer, and applying the resultant emulsion on a given substrate. Now, concrete examples of the dyes represented by the aforementioned general formula [XI] and [XII] will be cited.
Concrete examples of dye represented by general formula [XI]:
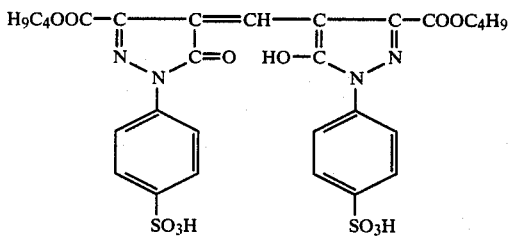
(XI-1)
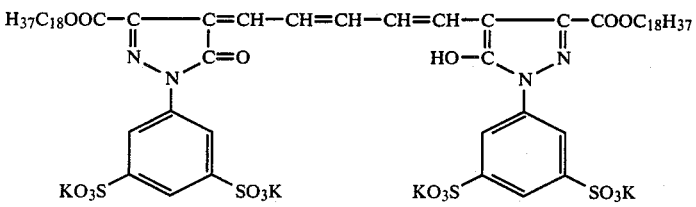
(XI-2)
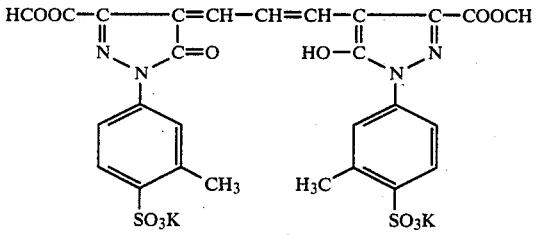
(XI-3)
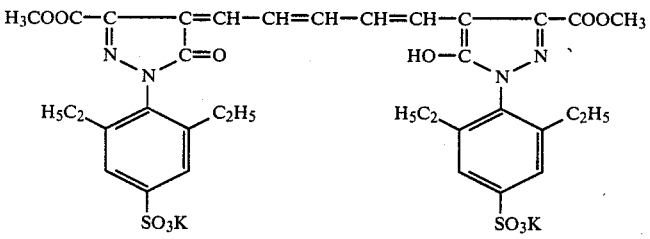
(XI-4)
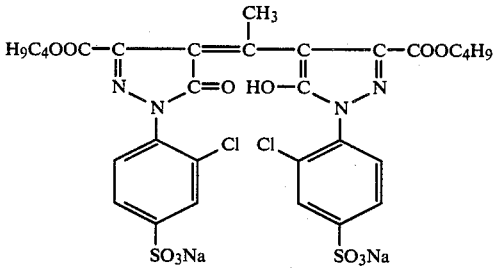
(XI-5)
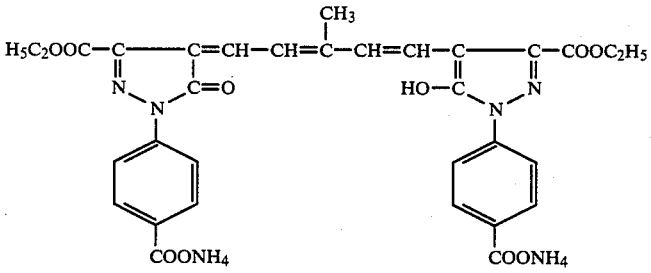
(XI-6)

-continued
(XI-7)
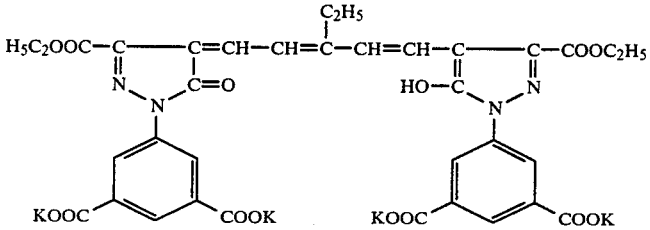
(XI-8)
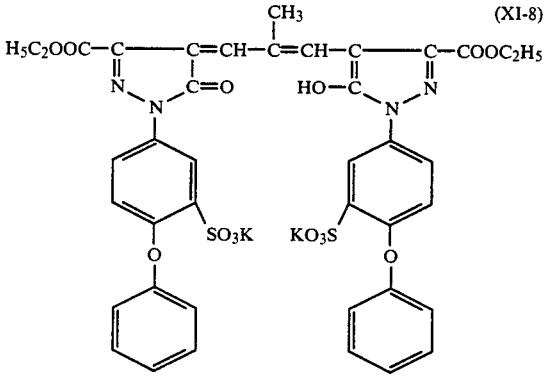
(XI-9)
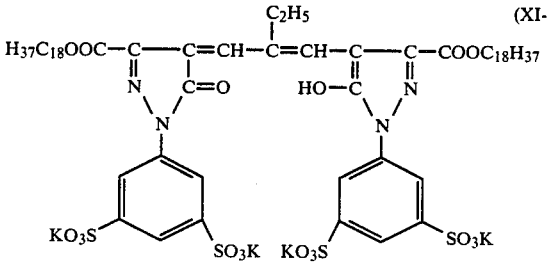
(XI-10)
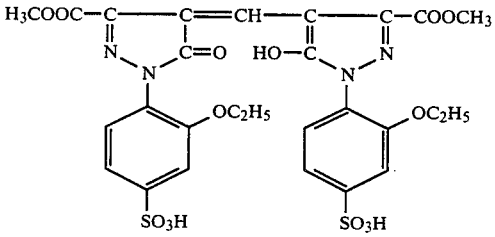
(XI-11)
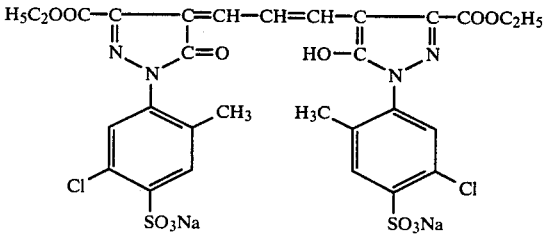
(XI-12)
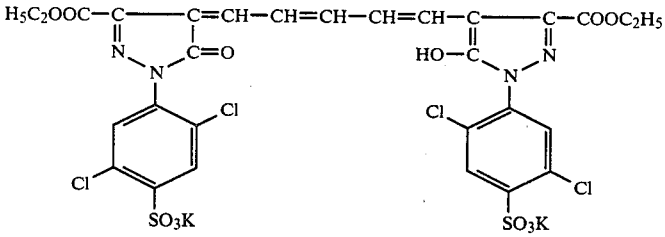
(XI-13)
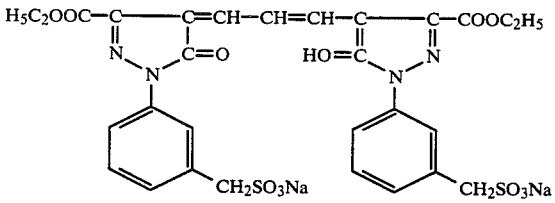
(XI-14)
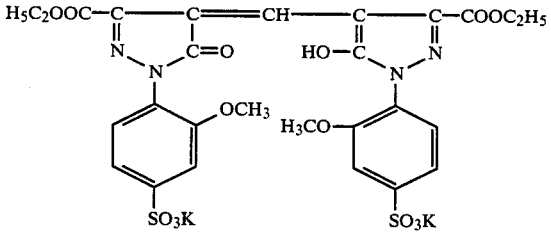
(XI-15)
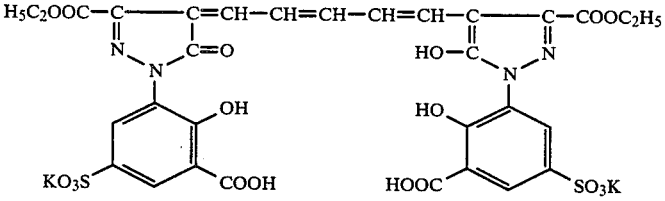

-continued
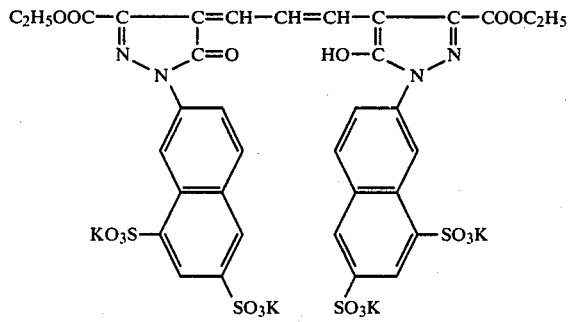
(XI-16)
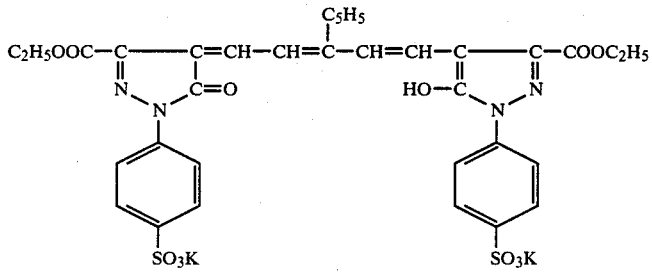
(XI-17)
(XI-18)
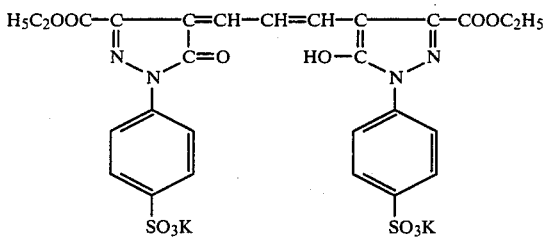
(XI-19)
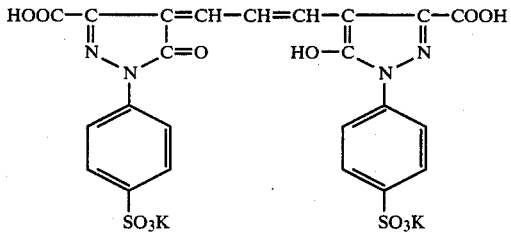
(XI-20)
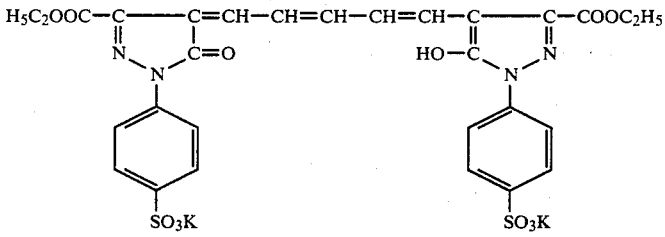
(XI-21)
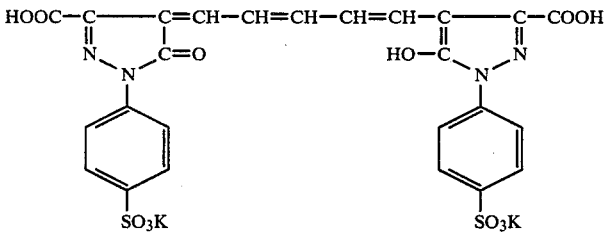
(XI-22)
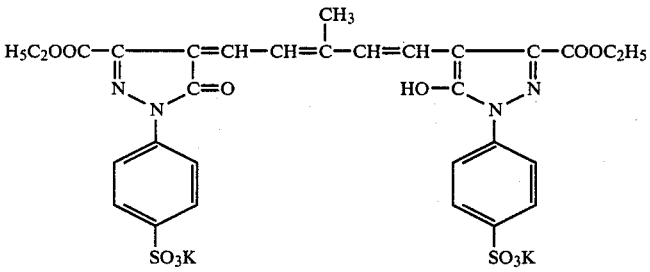

-continued
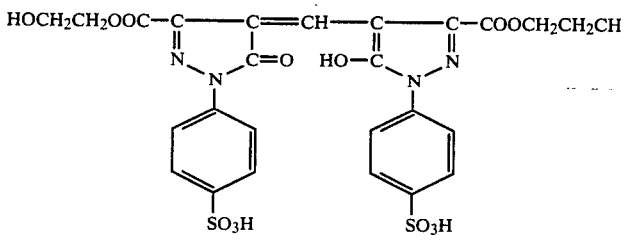
(XI-23)
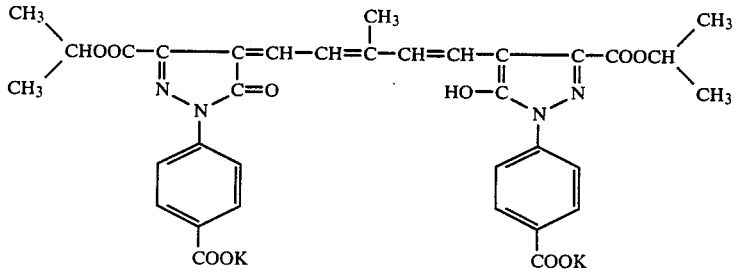
(XI-24)
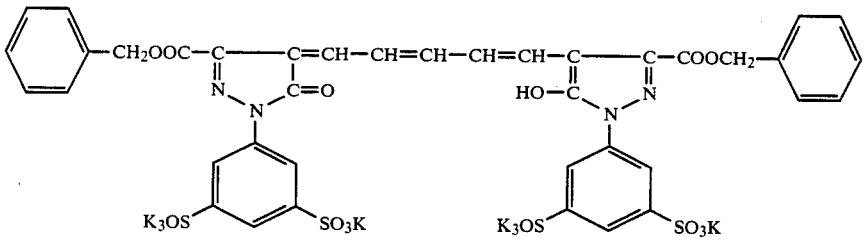
(XI-25)
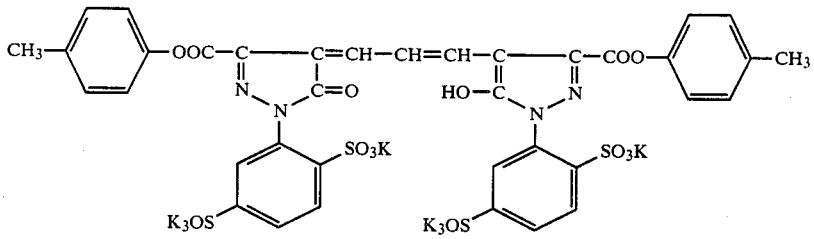
(XI-26)
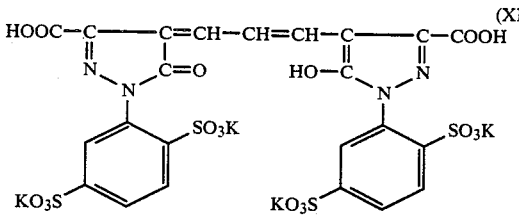
(XI-27)
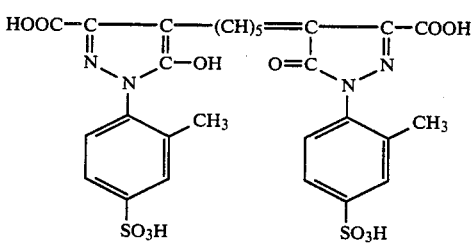
(XI-28)
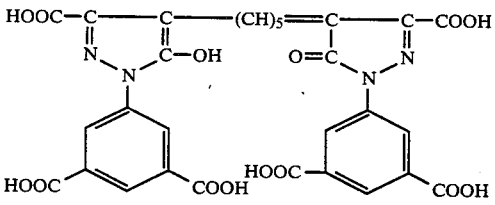
(XI-29)
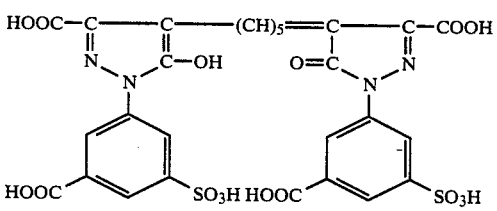
(XI-30)

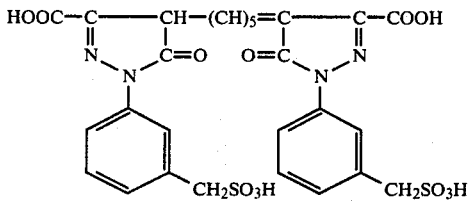

(XI-31)

-continued

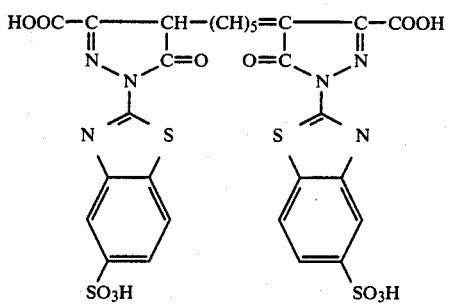

(XI-32)

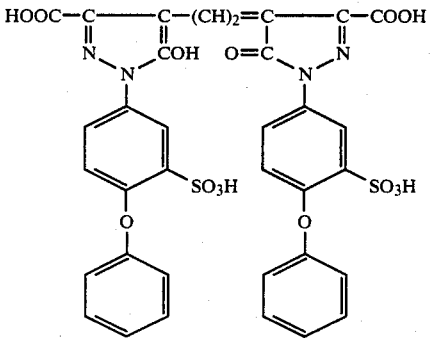

(XI-33)

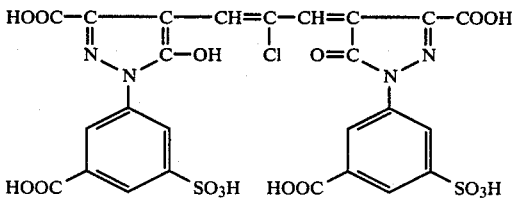

(XI-34)

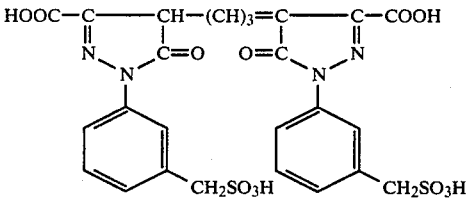

(XI-35)

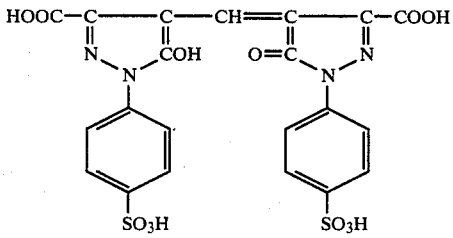

(XI-36)

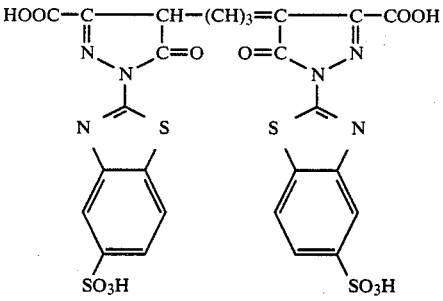

(XI-37)

The dyes represented by the aforementioned general formula [XI] can be produced by any of the methods of synthesis disclosed in Japanese Patent Publication SHO 51(1976)-46607 and SHO 39(1964)-22069, for example.

From this dye, the photographic layer can be obtained by dissolving the dye in water or in an organic solvent such as ethanol, methanol, or acetone which is miscible with water, adding the resultant solution to a hydrophilic colloidal binder capable of forming the aforementioned photographic layer, and applying the resultant emulsion on a given substrate.

To be more specific about the dye represented by the aforementioned general formula [XII], the symbol $R_o$ in the $OR_o$ group involved in $R_{41}$, $R_{44}$, $R_{45}$, and $R_{48}$ of the gneeral formula [XII] denotes an alkyl group or an aryl group. The alkyl group is desired to be methyl group or ethyl group. The aryl group is desired to be phenyl group. Then, examples of the alkyl group or aryl group possessing at least one sulfonate group or carboxyl group and denoted by $R'_o$ or $R''_o$ in the

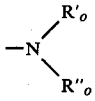

group involved in the symbols $R_{41}$, $R_{44}$, $R_{45}$, and $R_{48}$ include $—CH_2—SO_3Na$, $—CH_2CH_2—SO_3Na$, $—CH_2—COONa$, $—CH_2CH_2—COONa$,

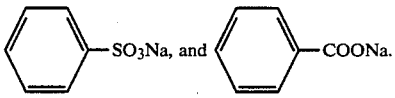

Examples of the alkyl group or aryl group possessing at least one sulfonate group or carboxyl group and denoted by $R_{42}$, $R_{43}$, $R_{46}$, and $R_{47}$ include $—CH_2—SO_3Na$, $—CH_2—COONa$,
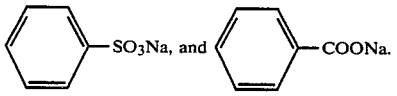
Typical examples of the dye represented by the general formula [XII] are as follows.
(Typical compounds)
(XII-1)
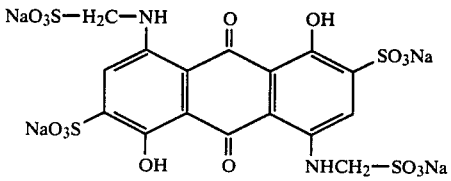
(XII-2)
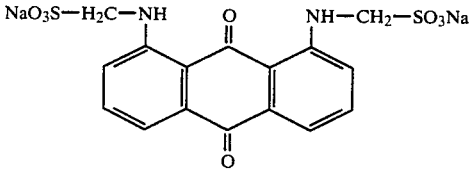
(XII-3)
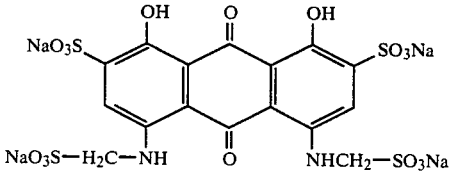
(XII-4)
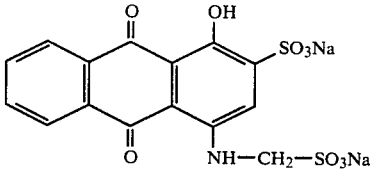
(XII-5)
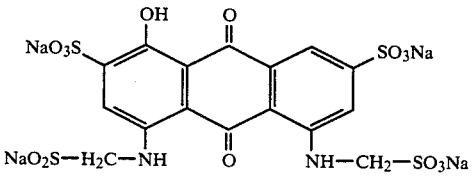
(XII-6)
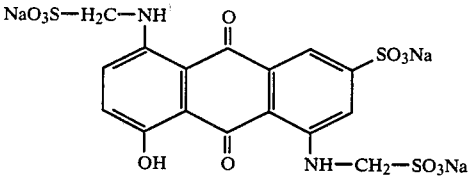
(XII-7)
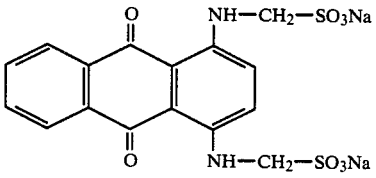
-continued
(Typical compounds)
(XII-8)
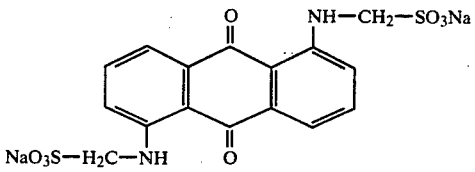
(XII-9)
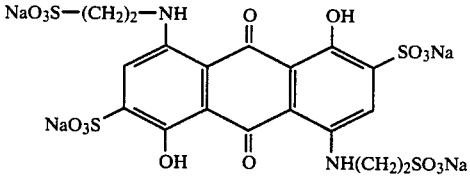
(XII-10)
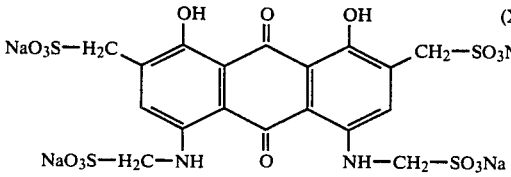
(XII-11)
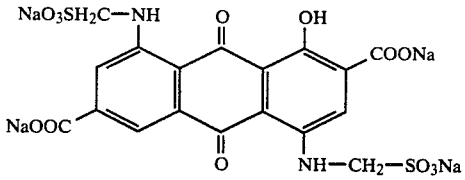
(XII-12)
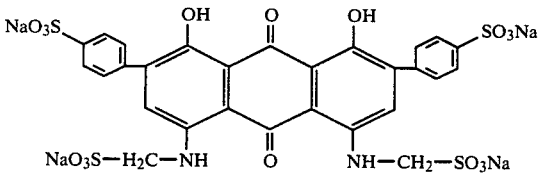
(XII-13)
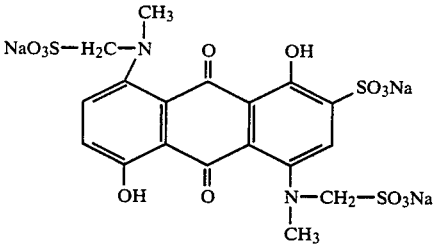
(XII-14)
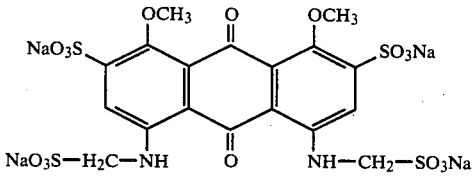
(XII-15)
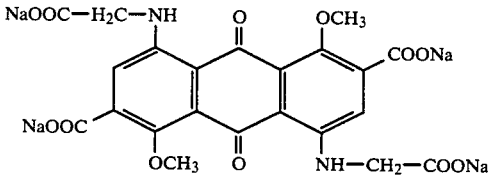

-continued (Typical compounds)

(XII-16)

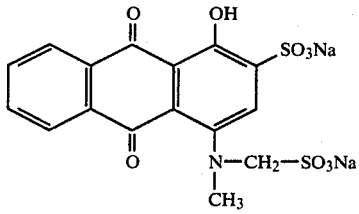

(XII-17)

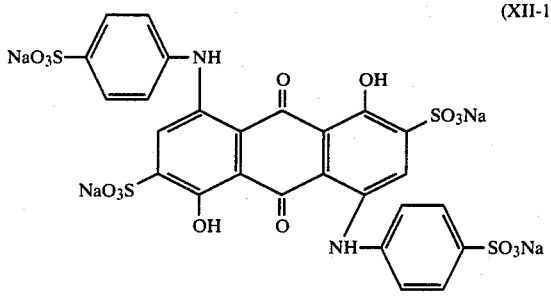

(XII-18)

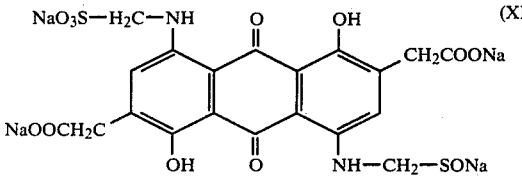

(XII-19)

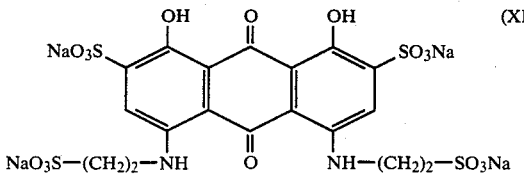

The oil-soluble dye to be used for the prevention of halation and irradiation is desired to be a compound represented by the general formula [XIII], the general formula [XIV], or the general formula [XV] indicated below.

General formula [VIII]

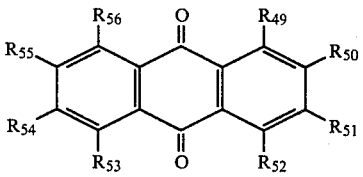

[wherein $R_{49}$–$R_{56}$ independently denote a hydrogen atom, a hydroxy group, an amino group, or a halogen atom].

General formula [XIV]

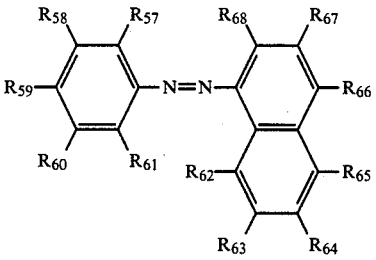

[wherein $R_{57}$–$R_{65}$ independently denote a hydrogen atom, a hydroxy group, an alkylamino group, an alkyl group, an alkoxy group, an amino group, or a —N=N-=Ar group (where Ar denotes an aryl group)].

General formula [XV]

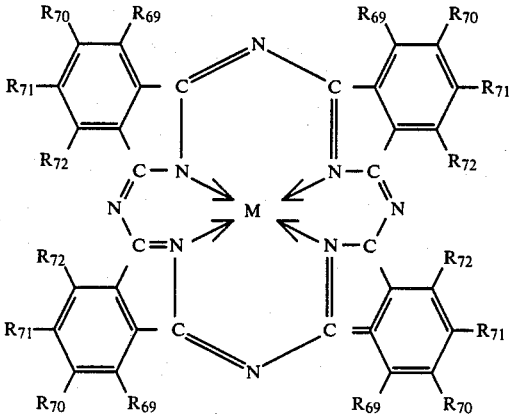

[wherein $R_{69}$–$R_{72}$ independently denote a hydrogen atom, a halogen atom, an alkyl group, an alkoxy group, an aryl group, an aryloxy group, or an alkylaminosulfonyl group, the couples of $R_{69}$ and $R_{70}$, $R_{70}$ and $R_{71}$, and $R_{71}$ and $R_{72}$ may jointly form a ring, and M denotes copper, nickel, or cobalt].

The dyes represented by the aforementioned general formulas [XIII], [XIV], and [XV] can be synthesized by the method disclosed in "Handbook on Dyes", compiled by Organic Synthetic Chemistry Association and published in July, 1970 by Maruzen Book Co. They are readily available as commercial products.

Dispersion of the dye in the composition for the photographic layer can be effected particularly advantageously by the oil-in-water type emulsion dispersion method and the latex dispersion method as well known in relation to the preparation of coupler.

Examples of the latex to be used in the latex dispersion method include homopolymers, copolymers, and terpolymers of such monomers as ethylene, ethyl acrylate, and N-isopropyl acrylate. For the oil-in-water dispersion, any of the various methods heretofore known in relation to the treatment of couplers and other hydrophobic additives can be adopted.

The dyes according with the present invention may be used singly or collectively in the form of a mixture or two or more members. The amount of the day to be added is in the range of $1\times10^{-2}$ to 10 mg/m$^2$, preferably 0.1 to 5 mg/m$^2$. When two or more dyes are simultaneously used, the total amount thereof is desired to fall in the range of $1\times10^{-2}$ to 20 mg/m$^2$, preferably 0.1 to 10 mg/m$^2$.

The addition of the dye is desired to be made in any of the photographic layers, preferably in the protective layer.

Now, concrete examples of the oil-soluble dyes represented by the aforementioned general formolas [XIII], [XIV], and [XV] will be cited below.

Typical examples of the dye represented by the general formula [XIII] are as follows.

(Typical compounds)

(XIII-1)

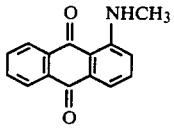

(XIII-2)

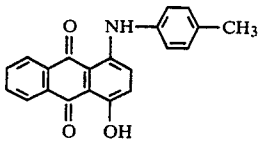

(XIII-3)

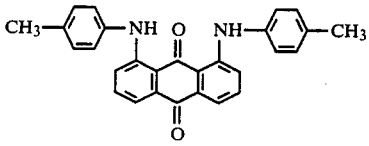

(XIII-4)

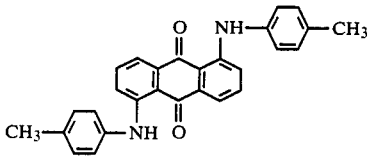

(XIII-5)

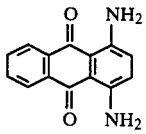

(XIII-6)

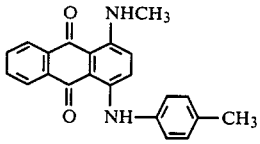

(XIII-7)

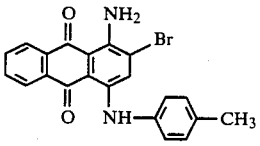

(XIII-8)

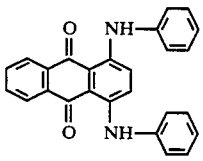

(XIII-9)

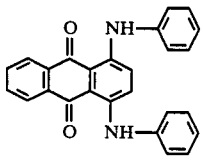

(XIII-10)

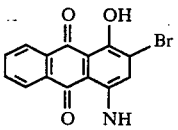

-continued (Typical compounds)

(XIII-11)

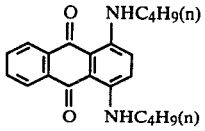

Now, the dyes represented by the general formula [XIV] will be described in detail below. In this general formula [XIV], the symbols $R_{57}$ and $R_{58}$ are desired to embrace hydrogen atom, alkyl groups (such as, for example, methyl group and ethyl group), alkoxy groups (such as, for example, methoxy group and ethoxy group), and —N=N—R groups (where R denotes a phenyl group, for example) and the symbols $R_{66}$ and $R_{68}$ are desired to embrace hydrogen atom, hydroxy group, amino groups, and alkylamino groups (such as, for example, methylamino group and N,N-diethylamino group).

Now, typical concrete examples of the dye represented by the general formula [XIV] will be cited below.

(Typical compounds)

(XIV-1)

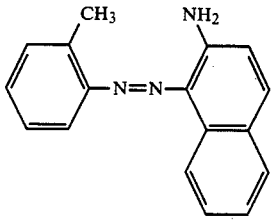

(XIV-2)

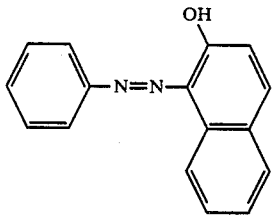

(XIV-3)

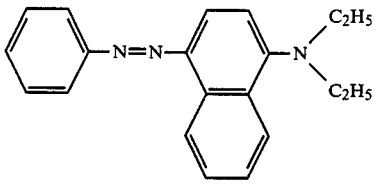

(XIV-4)

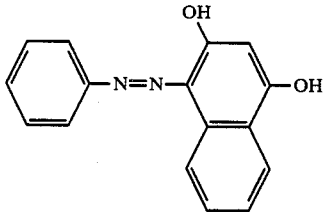

-continued
(Typical compounds)

(XIV-5)

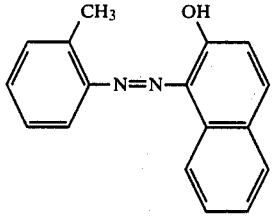

(XIV-6)

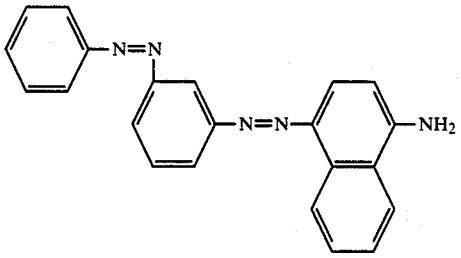

(XIV-7)

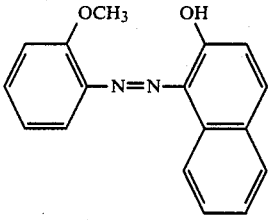

(XIV-8)

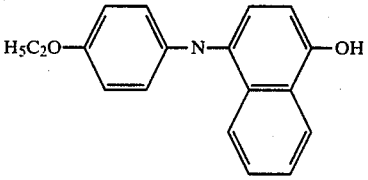

(XIV-9)

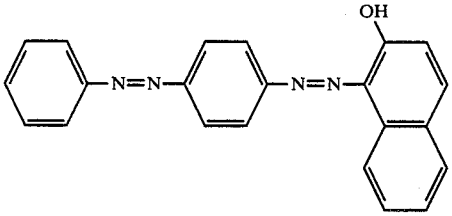

(XIV-10)

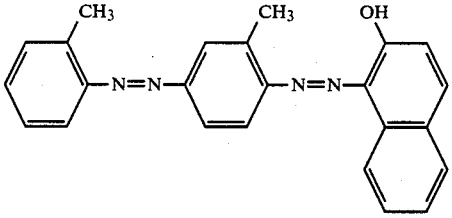

(XIV-11)

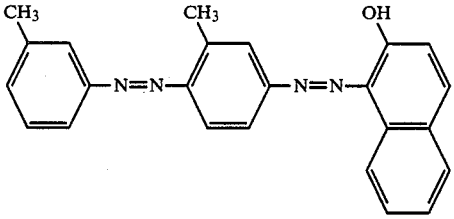

-continued
(Typical compounds)

(XIV-12)

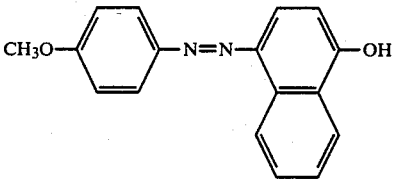

The dyes represented by the general formula [XV] will be described in further detail. Examples of the group denoted independently by the symbols $R_{69}$–$R_{72}$ include hydrogen atom, halogen atoms (such as chlorine atom), alkyl groups (such as methyl group and ethyl group), aryl groups (such as phenyl group and naphthyl group), alkoxy groups (such as methoxy group and ethoxy group), aryloxy groups (such as phenoxy group and naphthoxy group), and alkylaminosulfonyl groups (such as hexylaminosulfonyl group and 2,5-dimethoxyphenylpropylaminosulfonyl group). Particularly desirable examples are hydrogen atom, halogen atoms, aryl groups, and alkylaminosulfonyl groups. The metal atom denoted by the symbol M is desired to be copper.

Typical examples of the dye represented by the general formula [XV] are as follows.

General formula [XV]

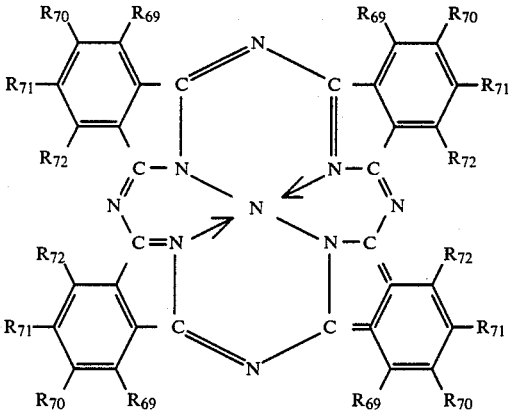

| Example | Substituent $R_{69}$ | $R_{70}$ | $R_{71}$ | $R_{72}$ | M |
|---|---|---|---|---|---|
| XV-1 | H | $-SO_2NH(CH_2)_3CH(CH_3)_2$ | H | H | Cu |
| XV-2 | H | 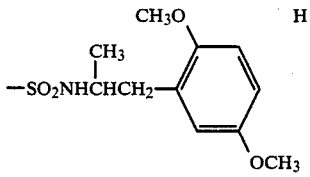 | H | H | Cu |
| XV-3 | Cl | Cl | Cl | Cl | Cu |
| XV-4 | H | 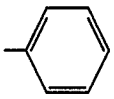 | H | H | Cu |
| IV-5 | H | $-SO_2NH(CH_2)_3CH(CH_3)_2$ | H | H | Co |

-continued

General formula [XV]

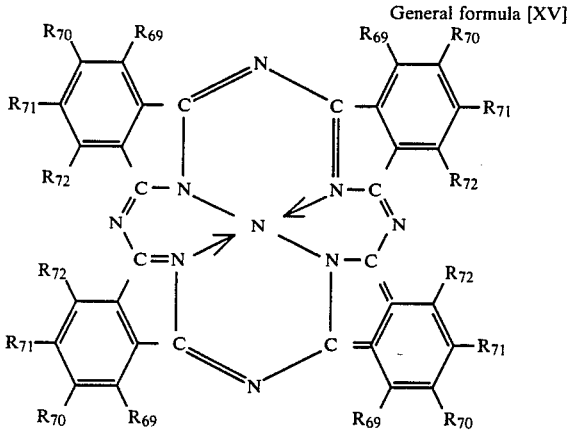

| Example | Substituent $R_{69}$ | $R_{70}$ | $R_{71}$ | $R_{72}$ | M |
|---|---|---|---|---|---|
| IV-6 | H | $CH_3O$, $-SO_2NHCH(CH_3)CH_2-$, $OCH_3$ | H | H | Co |
| IV-7 | Cl | Cl | Cl | Cl | Co |
| IV-9 | H | $-SO_2NH(CH_2)_3CH(CH_3)_2$ | H | H | Ni |
| IV-10 | H | $CH_3O$, $-SO_2NHCH(CH_3)CH_2-$, $OCH_3$ | H | H | Ni |
| IV-11 | Cl | Cl | Cl | Cl | Ni |
| IV-12 | H | | H | H | Ni |

The dyes represented by the aforementioned general formulas [XIII], [XIV], and [XV] can be synthesized by the method disclosed in "Handbook on Dyes," compiled by Organic Synthetic Chemistry Association and published in July, 1970 by Maruzen Book Co. They are readily available as commercial products.

Dispersion of the dyes according with the present invention in the composition for the photographic layer can be effected particularly advantageously by the oil-in-water type emulsion dispersion method and the latex dispersion method as well known in relation to the preparation of coupler.

Examples of the latex to be used in the latex dispersion method include homopolymers, copplymers, and terpolymers of such monomers as ethylene, ethyl acrylate, and N-isopropyl acrylate. For the oil-in-water dispersion, any of the various methods heretofore known in relation to the treatment of couplers and other hydrophobic additives can be adopted.

The dyes according with the present invention may be used singly or collectively in the form of a mixture or two or more members. The amount of the day to be added is in the range of $1\times10^{-2}$ to 10 mg/m$^2$, preferably 0.1 to 5 mg/m$^2$. When two or more dyes are simultaneously used, the total amount thereof is desired to fall in the range of $1\times10^{-2}$ to 20 mg/m$^2$, preferably 0.1 to 10 mg/m$^2$.

The addition of the dye is desired to be made in any of the photographic layers, preferably in the protective layer.

Now, the actual method of working this invention will be described. The silver halide color photographic sensitive material of this invention formed as described above is exposed to light and then subjected to color development of any of the various photographic treatments. The color developer to be advantageously used in the present invention is formed preponderantly of an aromatic primary amine type main color developing agent. Typical examples of the main color developing agent are p-phenylene diamine type agents such as diethyl p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)toluene, 2-amino-5-(N-ethyl-N-$\beta$-methane sulfonamide-ethyl)aminotoluene sulfate, 4-(N-ethyl-N-$\beta$-methane sulfonamideethylamino)-aniline, 4-(N-ethyl-N-$\beta$-hydroxyethylamino)aniline, and 2-amino-5-(N-ethyl-$\beta$-methoxyethyl)aminotoluene.

These main color developing agents can be used either singly or in the form of a mixture of two or more members. When necessary, the main color developing agent may be used in combination with a main monochromic developing agent such as, for example, hydroquinone. The color developing solution generally contains an alkali agent such as, for example, sodium hydroxide, ammonium hydroxide, sodium carbonate, or sodium sulfite. Optionally, it may contain various additives such as, for example, an alkali metal halide like potassium iodide, and a developing regulator such as, for example, hydrazoic acid.

The silver halide photographic sensitive material of the present invention is allowed to contain in the hydrophilic colloidal layer thereof the aforementioned main color developing agent either directly or in the form of a precursor. The precursor of the main color developing agent is a compound which is capable of producing the main color developing agent in an alkaline condition. Examples of the precursor include Schiff base type precursor incorporating an aromatic aldehyde derivative, a polyvalent metal ion complex precursor, a phthalic acid imide derivative precursor, phosphoric acid amide derivative precursor, sugar-amine reactant precursor, and urethane type precursor. The precursors of aromatic primary amine main color developing agents are disclosed in the specifications of U.S. Pat. Nos. 3,342,599, 2,507,114, 2,695,234, and 3,719,492 and British Pat. No. 803,783, the specifications of Japanese Patent Application Laid-open SHO 53(1978)-135,628 and SHO 54(1979)-79,035, and Research Disclosure No. 15,159, No. 12,146, and No. 13,924, for example.

The aromatic primary amine main color developing agent or the precursor thereof is required to be incorporated in an ample amount enough to provide sufficient color development during the course of development.

Although this amount is widely variable with the kind of sensitive material used and other similar factors, it is generally in the range of 0.1 to 5 mols, preferably 0.5 to 3 mols, per mol of the sensitive silver halide. The various main color developing agents and their precursors available for use in the present invention can be used either singly or in the form of a mixture of two or more members. Incorporation of these compounds in the photographic sensitive material can be effected by dissolving them in a suitable solvent such as water, methanol, ethanol, or acetone, and adding the resultant solution to the composition prepared for the sensitive material. Otherwise, the incorporation may be attained by dispersing the compounds in a high boiling organic solvent such as dibutyl phthalate, dioctyl phthalate, or tricresyl phosphate and adding the resultant emulsion to the aforementioned composition. Alternatively, they may be added as absorbed in a latex polymer of the type disclosed in Research Disclosure No. 14,860, for example.

The silver halide photographic sensitive material of the present invention, subsequently to the step of color development, is generally subjected to bleaching and fixation or bleaching-fixation and washing with water. Various compounds are available as bleaching agents. Particularly desirable compounds so usable are compounds of such polyvalent metals as iron (III), cobalt (III), and tin (II), preferably complexes of cations of such polyvalent metals with organic acids. Examples of these preferable complexes include metal complexes, ferricyanates, and bichromates of ethylenediamine tetraacetic acid, nitrilotriacetic acid, N-hydroxyethylethylenediamine diacetic acid, and other aminopolycarboxylic acids, malonic acid, tartaric acid, malic acid, diglycolic acid, and dithioglycolic acid. These compounds may be used either singly or in the form of a suitable mixture of two or more members.

In accordance with this invention, there is produced a silver halide color photographic sensitive material which enjoys good film properties, specifically high gloss, high scratch strength, and high swelling property, and also excels in stability of latent image in the cyan coloring material layer.

Now, this invention will be described more specifically below with reference to working examples. It should be noted, however, that this invention is not limited in any sense by these working examples.

EXAMPLE 1

In a mixed solution consisting of 5 ml of dioctyl phthalate and 30 ml of ethyl acetate, a varying cyan coupler according with this invention shown in Table 1 or a varying cyan coupler (A, B, or C) given for comparison was thoroughly dissolved under application of heat. In an ultra-homogenizer, the resultant solution, 5 ml of an aqueous 10% Alkanol XC (sodium alkylnaphthalene sulfonate produced and marketed by DuPont) solution and 200 ml of an aqueous 5% gelatin solution added thereto were emulsified, to afford a coupler dispersion. Then, the coupler dispersion was added to 500 g of silver chlorobromide (containing 80 mol% of silver bromide) emulsion. The resultant mixture was applied on a substrate of polyethylene-coated paper. As a protective layer, a hardening agent (II-1) according with this invention was applied in a ratio of 0.01 g per g of gelatin (total of gelatin contained in the aforementioned emulsion layer and the protective layer) or a hardening agent H-1 given for comparison was applied in a ratio of 0.02 g per g of gelatin (total of gelatin contained in the aforementioned emulsion layer and the protective layer) on the formed emulsion layer and then dried. Consequently, there were obtained samples, Nos. 1–7, of monochromic photographic element.

Cyan couplers for comparison

A

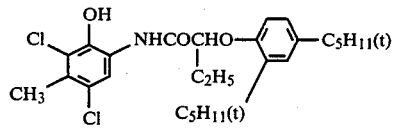

B

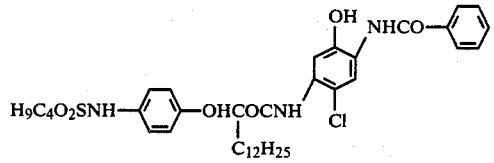

C

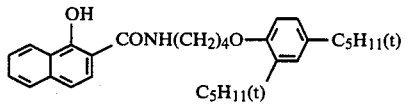

Hardening agent for comparison $C{\equiv}CH_2SO_2CH{=}CH_2)_4$ H-1

The samples, Nos. 1–7, were tested for gloss, scratch strength, and latent image stability by the respective procedures described below.

Gloss

A given sample was subjected to optical-wedge exposure by the use of a sensitivity meter (Model KS-7 from Konishiroku Photo Industry Co., Ltd.) and then to the following treatments.

| Step of treatment | Temperature | Time |
|---|---|---|
| Color development | 32.8° C. | 3 min. 30 sec. |
| Bleaching and fixation | 32.8° C. | 1 min. 30 sec. |
| Washing with water | 32.8° C. | 3 min. 30 sec. |

The solution used for the aforementioned treatments were composed as follows.

Composition of Color Developing Solution

| | |
|---|---|
| 4-Amino-3-methyl-N—ethyl-N—(β-methane sulfonamide-ethyl)-aniline sulfate | 5 g |
| Benzyl alcohol | 15 ml |
| Sodium hexamethaphosphate | 2.5 g |
| Anhydrous sodium sulfite | 1.85 g |
| Sodium bromide | 1.4 g |
| Potassium bromide | 0.5 g |
| Borax | 39.1 g |
| The components were diluted with water to a total volume of 1 liter and the resultant solution was adjusted to pH 10.3 by addition of sodium hydroxide. | |

Composition for Bleaching and Fixation

| | |
|---|---|
| Ethylenediamine tetraacetic acid iron ammonium | 61.0 g |
| Ethylenediamine tetraacetic acid diammonium salt | 5.0 g |
| Ammonium thiosulfate | 124.5 g |
| Sodium metabisulfite | 13.5 g |
| Anhydrous sodium sulfite | 2.7 g |
| The components were diluted with water to a total | |

-continued volume of 1 liter.

The blank sample obtained after the treatment of development was tested for gloss. The measurement of gloss was made by the use of a gloss meter made by Tokyo Denshoku Co. The sample was then exposured to the xenone light for 300 hours in a xenone fade meter and then tested again for gloss.

Scratch Strength

A given sample was immersed in the aforementioned color developing solution for three minutes and tested for scratch strength (g) by the use of a scratch meter made by Heydon Corp.

Latent Image Stability

A given sample which had undergone the aforementioned exposure test was immediately tested for sensitivity by sensitometory, with the found value of sensitivity reported as 100. The sample was then left standing at room temperature for six hours. It was then subjected to the same test by sensitometry. The sensitivity of the sample in the second test was reported as relative sensitivity. The results are shown in Table 1.

TABLE 1

| Sample No. | Hardening agent | Cyan coupler | Gloss: After treatment | Gloss: Exposure to Xe light | Scratch strength (g) | Latent image stability |
|---|---|---|---|---|---|---|
| 1 | H-1 | A | 91 | 84 | 24 | 91 |
| 2 | (II-1) | A | 94 | 91 | 48 | 77 |
| 3 | (II-1) | B | 93 | 90 | 47 | 79 |
| 4 | (II-1) | C | 93 | 90 | 49 | 79 |
| 5* | (II-1) | (I-1) | 94 | 90 | 47 | 98 |
| 6* | (II-1) | (I-4) | 93 | 91 | 47 | 99 |
| 7* | (II-1) | (I-8) | 94 | 91 | 48 | 99 |

(Note) *Sample of this invention

It is noted from Table 1 that the samples, Nos. 2–7, using hardening agents according with this invention excelled the sample using a comparative hardening agent in terms of gloss and scratch strength.

Further in terms of latent image stability, in the case of cyan coupler used for comparison, the samples, Nos. 2–4, using this cyan coupler in combination with the hardening agents according with this invention were inferior to the sample, No. 1, using the cyan coupler in combination with the hardening agent used for comparison, whereas in the case of cyan couplers according with this invention, the samples, Nos. 5–7, using these cyan couplers with the hardening agents according with this invention showed outstanding latent image stability.

EXAMPLE 2

On a substrate of polyethylene-coated paper, a varying combination of component layers shown in Table 2 was applied, with the layers sequentially superposed in the order of increasing distance from the substrate, to produce samples, Nos. 8–17, of polymeric element reflecting varying combinations of cyan couplers and hardening agents according with this invention and combinations of conventional cyan couplers and hardening agents. These samples were subjected various tests by respective procedures indicated below.

The ultraviolet light absorbents, UV-1 and UV-2, coloring matter image stabilizer S-1, and hardening agent H-2 for comparison used herein are shown below. The hardening agent H-1 used for comparison has already been identified.

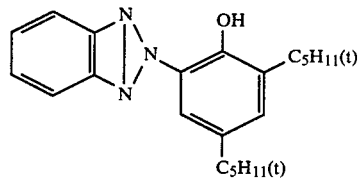

UV-1

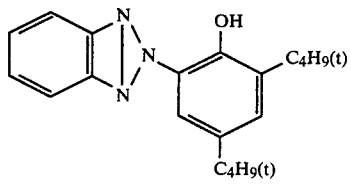

UV-2

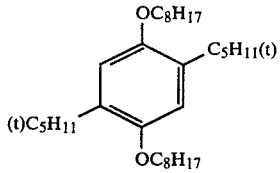

S-1

1,3,5-Triacryloylhexahydro-S—triazine H-2

Gloss

The test for gloss was carried out under the same conditions by the same procedure as in Example 1.

Scratch Strength

The test for scratch strength was carried out under the same conditions by the same procedure as in Example 1.

Degree of Swelling

This test was carried out by allowing a given sample to stand in a constant-temperature constant-humidity chamber at 35° C. and 50% RH for two days and for five days and measuring the treated sample for degree of swelling in accordance with the following formula.

$$\text{Degree of swelling (\%)} = \frac{\text{Film thickness immersed in color developing solution at 33° C.}}{\text{Film thickness in dry state}} \times 100$$

Latent Image Stability

The red sensitive emulsion layer of a given sample was tested for relative sensitivity by following the procedure of Example 1.

The results of the tests described above are shown in Table 3.

TABLE 2

| Layer | Construction | Amount applied mg/dm$^2$ |
|---|---|---|
| 7th layer (protective layer) | Gelatin | 10.0 |
| 6th layer (ultraviolet light absorption layer) | Gelatin | 10.0 |
| | Ultraviolet light absorbent UV-1 | 2.0 |
| | Ultraviolet light absorbent UV-2 | 2.0 |
| | High boiling solvent (VII-2) | 2.0 |
| 5th layer (red sensitive layer | Gelatin | 15.0 |
| | Silver colorobromide emulsion (silver bromide content 80 mol %) | 2.0 (as silver) |
| | Cyan coupler | 4.5 |
| | Color image stabilizer (IX-65) | 2.0 |
| | High boiling solvent (VII-2) | 2.0 |
| | Water-soluble dye (XII-1) | 0.15 |
| 4th layer (ultraviolet light absorption layer) | Gelatin | 15.0 |
| | Ultraviolet light absorbent UV-1 | 3.0 |
| | Ultraviolet light absorbent UV-2 | 3.0 |
| | Oil-soluble dye (XIII-10) | 0.003 |
| | Oil-soluble dye (XIII-11) | 0.004 |
| | High boiling solvent (VII-2) | 3.0 |
| 3rd layer (green sensitive layer) | Gelatin | 15.0 |
| | Silver chlorobromide emulsion (silver bromide content 80 mol %) | 3.0 (as silver) |
| | Magenta coupler (VI-22) | 3.0 |
| | Color image stabilizer (S-1) | 1.0 |
| | high boiling solvent (VII-2) | 1.5 |
| | Water-soluble dye (XI-27) | 0.04 |
| 2nd layer (intermediate layer) | Gelatin | 10.0 |
| 1st layer (blue sensitive layer) | Gelatin | 15.0 |
| | Silver chlorobromide emulsion silver bromide content 90 mol %) | 3.0 (as silver) |
| | Yellow coupler (X-7) | 6.0 |
| | High boiling solvent (VII-3) | 3.0 |
| Substrate | Polyethylene-coated paper | |

TABLE 3

| Sample No. | Hardening agent | Hardening agent (g/l g of gelatin) | Cyan coupler | Gloss After treatment | Gloss After 300 hours' exposure to Xe | Scratch strength (g) | Degree of swelling 2 days | Degree of swelling 5 days | Latent image stability |
|---|---|---|---|---|---|---|---|---|---|
| 8 | H-1 | 0.02 | A | 91 | 84 | 27 | 352 | 312 | 90 |
| 9 | H-2 | 0.02 | A | 92 | 88 | 47 | 588 | 325 | 91 |
| 10 | (II-1) | 0.01 | A | 93 | 91 | 49 | 321 | 318 | 77 |
| 11 | (II-2) | 0.02 | A | 95 | 92 | 50 | 320 | 316 | 77 |
| 12 | (III-2) | 0.02 | A | 93 | 92 | 48 | 319 | 316 | 79 |
| 13 | H-1 | 0.02 | (I-1) | 88 | 81 | 28 | 350 | 320 | 91 |
| 14 | H-2 | 0.02 | (I-1) | 91 | 89 | 49 | 584 | 318 | 92 |
| 15* | (II-1) | 0.01 | (I-1) | 94 | 93 | 51 | 320 | 317 | 98 |
| 16* | (II-2) | 0.02 | (I-1) | 95 | 93 | 50 | 318 | 316 | 99 |
| 17* | (III-2) | 0.02 | (I-1) | 95 | 93 | 50 | 321 | 320 | 98 |
| 18* | (II-1) | 0.01 | (I-4) | 94 | 92 | 51 | 322 | 318 | 98 |
| 19* | (II-2) | 0.02 | (I-4) | 94 | 93 | 52 | 320 | 317 | 99 |
| 20* | (III-2) | 0.02 | (I-4) | 95 | 93 | 51 | 322 | 319 | 98 |

(Note) *Sample of this invention

It is noted from Table 3 that the samples, No. 8 and No. 13, using the hardening agent H-1 for comparison were inferior in gloss and scratch strength and the samples, No. 9 and No. 14, using the hardening agent H-2 for comparison, were superior in gloss and scratch strength to the samples, No. 8 and No. 13 but were inferior in degree of quick hardening because of great length of time required for the degree of swelling to reach a fixed level, whereas the samples, Nos. 10–12 and Nos. 15–20, using the hardening agents according with the present invention were excellent in all the test items, i.e gloss, scratch strength, and swelling degree.

Further, it is noted that the samples, Nos. 10–12, using the hardening agents according with the present invention in combination with the cyan couplers used for comparison were inferior in latent image stability, wereas the samples, Nos. 15–20, using the same hardening agents in combination with the cyan couplers according with this invention exhibited outstanding latent image stability.

Thus, similarly to the monochromic photographic samples of Example 1, the photographic sensitive materials produced in the present example excelled in film properties and latent image stability owing to the specific combinations of the hardening agents and the cyan couplers both according with this invention.

What is claimed is:

1. A silver halide photographic light-sensitive material comprising a support bearing thereon a silver halide emulsion layer containing a diffusionproof coupler and being treated with a hardening agent represented by Formula [II] and/or Formula [III] indicated below, said silver halide photographic light-sensitive material characterized in that said diffusionproof coupler is a coupler represented by Formula [I] indicated below:

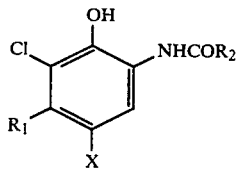

Formula [I]

wherein $R_1$ denotes a straight or branched alkyl group having 2 to 4 carbon atoms; $R_2$ a ballast group; and X a hydrogen atom or a group capable of splitting off through reaction with the oxidation product of an aromatic primary amine type color developing agent.

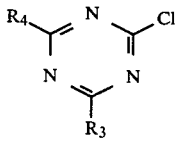

Formula [II]

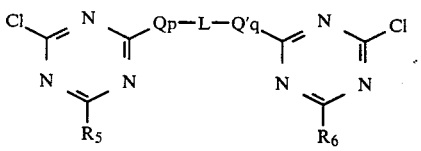

Formula [III]

wherein $R_3$ denotes a chlorine atom, a hydroxy group, an alkyl group, an alkoxy group, an amino group, an acylamino group, or a —OM group in which M denotes a monovalent metal atom; $R_4$ has the same meaning as $R_3$ except for the omission of said chlorine atom; $R_5$ and $R_6$ independently denote a chlorine atom, a hydroxy group, an alkyl group, an alkoxy group, or a —OM group in which M denotes a monovalent metal atom; Q and Q' independently denote a linking group —O—, —S—, or —NH—; L denotes an alkylene group or an arylene group; and p and q independently denote 0 or 1.

2. A silver halide photographic light-sensitive material according to claim 1, wherein said alkyl group denoted by $R_1$ in said Formula [I] is selected from the group consisting of ethyl, propyl, butyl, iso-propyl, iso-butyl, sec-butyl, and tert-butyl groups.

3. A silver halide photographic light-sensitive material according to claim 1, wherein said ballast group denoted by $R_2$ in said Formula [I] is an organic group possessing size and shape capable of conferring upon said diffusionproof coupler high bulkiness enough to prevent said coupler from being diffused into other adjoining layer.

4. A silver halide photographic light-sensitive material according to claim 1, wherein said ballast group denoted by $R_2$ in said Formula [I] is an alkyl group or aryl group having a total of 8 to 32 carbon atoms.

5. A silver halide photographic light-sensitive material according to claim 1, wherein said ballast group denoted by $R_2$ in said Formula [I] is a group represented by the following formula:

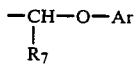

wherein, $R_7$ denotes an alkyl group having 1 to 12 carbon atoms and Ar denotes an aryl group.

* * * * *